US008894253B2

(12) United States Patent
Rowlette, Jr. et al.

(10) Patent No.: US 8,894,253 B2
(45) Date of Patent: Nov. 25, 2014

(54) HEAT TRANSFER BRACKET FOR LIGHTING FIXTURE

(75) Inventors: John R. Rowlette, Jr., Raleigh, NC (US); Long Larry Le, Morrisville, NC (US)

(73) Assignee: Cree, Inc., Durham, NC (US)

( * ) Notice: Subject to any disclaimer, the term of this patent is extended or adjusted under 35 U.S.C. 154(b) by 647 days.

(21) Appl. No.: 13/042,388

(22) Filed: Mar. 7, 2011

(65) Prior Publication Data

US 2012/0140490 A1 Jun. 7, 2012

Related U.S. Application Data

(60) Provisional application No. 61/419,415, filed on Dec. 3, 2010.

(51) Int. Cl.
*F21V 29/00* (2006.01)

(52) U.S. Cl.
USPC ..... 362/373; 362/147; 362/294

(58) Field of Classification Search
USPC ..... 362/147, 218, 294, 364, 365, 373, 404, 362/432
See application file for complete search history.

(56) References Cited

U.S. PATENT DOCUMENTS

| | | | |
|---|---|---|---|
| D47,607 | S | 7/1915 | Owen |
| D109,740 | S | 5/1938 | Stewart |
| D134,595 | S | 11/1941 | van Es |
| D158,821 | S | 5/1950 | Walter |
| D199,141 | S | 9/1964 | Curry |
| D231,679 | S | 5/1974 | Keller |
| D231,680 | S | 5/1974 | Keller |
| D238,185 | S | 12/1975 | Wellward et al. |
| 5,034,869 | A | 7/1991 | Choi |
| D325,999 | S | 5/1992 | Sonneman |
| D326,537 | S | 5/1992 | Gattari |
| D341,442 | S | 11/1993 | Shapiro |
| 5,477,441 | A | 12/1995 | Budnovitch et al. |
| D375,605 | S | 11/1996 | Balish, Jr. |

(Continued)

FOREIGN PATENT DOCUMENTS

| | | |
|---|---|---|
| CN | 3557377 | 8/2006 |
| EM | 000380670-0001 | 8/2005 |

(Continued)

OTHER PUBLICATIONS

Non-final Office Action for U.S. Appl. No. 13/042,378 mailed Sep. 4, 2012, 20 pages.

(Continued)

*Primary Examiner* — Y My Quach Lee
(74) *Attorney, Agent, or Firm* — Withrow & Terranova, P.L.L.C.

(57) ABSTRACT

The present disclosure relates to a heat transfer bracket that is configured to mount to a lighting fixture, which includes a heat spreading structure that is formed from a material that efficiently conducts heat and a light source and control electronics that are thermally coupled to the heat spreading structure. The heat transfer bracket includes a base that is thermally coupled to the heat spreading structure of the lighting fixture and multiple petals that extend from the base, wherein heat generated from the light source and control electronics is transferred to the heat spreading structure and from the heat spreading structure to the base of the heat transfer bracket. The heat is then further transferred along the plurality of petals.

36 Claims, 30 Drawing Sheets

(56) References Cited

U.S. PATENT DOCUMENTS

| | | | | |
|---|---|---|---|---|
| D383,564 | S | 9/1997 | Lecluze | |
| 5,664,869 | A | 9/1997 | Bitton | |
| D386,805 | S | 11/1997 | Bonnette et al. | |
| D392,764 | S | 3/1998 | Balish, Jr. | |
| D397,472 | S | 8/1998 | Lecluze | |
| D399,021 | S | 9/1998 | Lam | |
| 5,800,038 | A | 9/1998 | McCool | |
| D399,590 | S | 10/1998 | Lecluze | |
| D400,274 | S | 10/1998 | Ziaylek, Jr. et al. | |
| D411,640 | S | 6/1999 | Lueken et al. | |
| D413,997 | S | 9/1999 | Jandrisits et al. | |
| D421,316 | S | 2/2000 | Fiorato | |
| D433,179 | S | 10/2000 | Johnson | |
| 6,152,582 | A | 11/2000 | Klaus | |
| 6,193,392 | B1 | 2/2001 | Lodhie | |
| D457,677 | S | 5/2002 | Landefeld et al. | |
| D459,504 | S | 6/2002 | Chen | |
| D468,044 | S | 12/2002 | Lam | |
| D468,477 | S | 1/2003 | Landefeld et al. | |
| D473,966 | S | 4/2003 | Lecluze | |
| D474,298 | S | 5/2003 | Lecluze | |
| 6,644,834 | B2 | 11/2003 | Christen | |
| D488,251 | S | 4/2004 | Benghozi | |
| D488,583 | S | 4/2004 | Benghozi | |
| D506,280 | S | 6/2005 | Chen | |
| 6,913,371 | B2 | 7/2005 | Ping | |
| D508,141 | S | 8/2005 | Rashidi | |
| D508,750 | S | 8/2005 | Rashidi | |
| D509,017 | S | 8/2005 | Rashidi | |
| D509,615 | S | 9/2005 | Rashidi | |
| D544,979 | S | 6/2007 | Hartmann, Jr. et al. | |
| D547,484 | S | 7/2007 | Guercio | |
| D548,390 | S | 8/2007 | Lecluze | |
| D549,384 | S | 8/2007 | Grawunder | |
| D558,377 | S | 12/2007 | Rashidi | |
| D558,378 | S | 12/2007 | Rashidi | |
| D560,204 | S | 1/2008 | Bhavnani | |
| D561,374 | S | 2/2008 | Hartmann, Jr. et al. | |
| D570,515 | S | 6/2008 | Flaherty et al. | |
| D574,104 | S | 7/2008 | Sanoner | |
| D588,296 | S | 3/2009 | Sabernig | |
| D588,735 | S | 3/2009 | Woodard | |
| D591,894 | S | 5/2009 | Flank | |
| 7,549,772 | B2 | 6/2009 | Wang | |
| D596,334 | S | 7/2009 | Sabernig | |
| 7,614,769 | B2 | 11/2009 | Sell | |
| D606,696 | S | 12/2009 | Chen et al. | |
| D607,140 | S | 12/2009 | Farris et al. | |
| D608,044 | S | 1/2010 | Pickett | |
| D609,840 | S | 2/2010 | Tang | |
| D610,292 | S | 2/2010 | Yoshinobu et al. | |
| 7,677,767 | B2 | 3/2010 | Chyn | |
| D614,337 | S | 4/2010 | Robinson et al. | |
| D617,934 | S | 6/2010 | Rashidi | |
| D622,434 | S | 8/2010 | Ward et al. | |
| 7,771,086 | B2 * | 8/2010 | Goverde | 362/294 |
| 7,789,535 | B2 * | 9/2010 | Wang et al. | 362/373 |
| D625,876 | S | 10/2010 | Chen et al. | |
| D625,879 | S | 10/2010 | Sabernig | |
| D626,676 | S | 11/2010 | Johnson | |
| D628,733 | S | 12/2010 | Cobb, III et al. | |
| 7,862,214 | B2 * | 1/2011 | Trott et al. | 362/365 |
| D632,822 | S | 2/2011 | Bitton | |
| D646,429 | S | 10/2011 | Sabernig | |
| 8,104,928 | B1 | 1/2012 | Horn | |
| D655,855 | S | 3/2012 | Sabernig | |
| D656,263 | S | 3/2012 | Ogawa et al. | |
| 8,240,871 | B2 | 8/2012 | Chou | |
| D671,259 | S | 11/2012 | Chen | |
| D671,668 | S | 11/2012 | Rowlette, Jr. et al. | |
| D672,899 | S | 12/2012 | Van De Ven et al. | |
| D674,127 | S | 1/2013 | Rowlette, Jr. et al. | |
| D692,171 | S | 10/2013 | Randolph et al. | |
| D694,456 | S | 11/2013 | Rowlette, Jr. et al. | |
| D695,941 | S | 12/2013 | Rashidi | |
| 2004/0050538 | A1 * | 3/2004 | Sunder et al. | 362/294 |
| 2005/0111234 | A1 | 5/2005 | Martin et al. | |
| 2007/0035951 | A1 | 2/2007 | Tseng | |
| 2007/0041220 | A1 | 2/2007 | Lynch | |
| 2008/0074889 | A1 | 3/2008 | Gloisten et al. | |
| 2008/0158887 | A1 | 7/2008 | Zhu et al. | |
| 2009/0086492 | A1 | 4/2009 | Meyer | |
| 2009/0219727 | A1 | 9/2009 | Weaver | |
| 2010/0061076 | A1 * | 3/2010 | Mandy et al. | 362/373 |
| 2010/0110699 | A1 | 5/2010 | Chou | |
| 2010/0164348 | A1 | 7/2010 | Huang et al. | |
| 2010/0226139 | A1 | 9/2010 | Lynch et al. | |
| 2010/0296272 | A1 | 11/2010 | Roos et al. | |
| 2011/0002124 | A1 * | 1/2011 | Chang et al. | 362/294 |
| 2011/0026261 | A1 * | 2/2011 | Kuan | 362/294 |
| 2012/0044704 | A1 | 2/2012 | Wilson et al. | |
| 2012/0230028 | A1 | 9/2012 | Foo | |
| 2013/0051012 | A1 | 2/2013 | Oehle et al. | |
| 2013/0141918 | A1 | 6/2013 | Harbers et al. | |
| 2014/0003061 | A1 | 1/2014 | Chen et al. | |

FOREIGN PATENT DOCUMENTS

| | | | |
|---|---|---|---|
| FR | 2909160 | A1 | 5/2008 |
| WO | 2008036596 | A1 | 3/2008 |
| WO | 2008061082 | A2 | 5/2008 |
| WO | 2008067447 | A1 | 6/2008 |
| WO | WO 2009111905 | A1 * | 9/2009 |
| WO | 2011037878 | A1 | 3/2011 |

OTHER PUBLICATIONS

Notice of Allowance for U.S. Appl. No. 29/379,154 mailed Aug. 13, 2012, 7 pages.

Quayle Action for U.S. Appl. No. 29/379,154 mailed May 30, 2012, 11 pages.

International Search Report for PCT/US20111062990 mailed Apr. 12, 2012, 10 pages.

International Search Report for PCT/US2011/062992 mailed Apr. 2, 2012, 12 pages.

International Search Report for PCT/US2012/067754 mailed Feb. 20, 2013, 11 pages.

Restriction Requirement for U.S. Appl. No. 29/408,232 mailed Jan. 16, 2013, 5 pages.

Final Office Action for U.S. Appl. No. 13/042,378 mailed Feb. 4, 2013, 20 pages.

Examiner's Answer to Appeal Brief for U.S. Appl. No. 13/042,378, mailed Aug. 6, 2013, 20 pages.

Notice of Allowance for U.S. Appl. No. 29/456,927, mailed Sep. 18, 2013, 8 pages.

Notice of Allowance for U.S. Appl. No. 29/408,234, mailed Mar. 14, 2014, 5 pages.

Notice of Allowance for U.S. Appl. No. 29/469,362, mailed Mar. 25, 2014, 5 pages.

International Preliminary Report on Patentability for PCT/US2012/067754, mailed Jun. 19, 2014, 8 pages.

Non-final Office Action for U.S. Appl. No. 13/649,531, mailed Jul. 31, 2014, 7 pages.

* cited by examiner

HEAT TRANSFER BRACKET FOR LIGHTING FIXTURE

RELATED APPLICATIONS

This application claims the benefit of U.S. Provisional Patent Application No. 61/419,415, filed Dec. 3, 2010, the disclosure of which is incorporated herein by reference in its entirety. This application is related to concurrently filed U.S. Utility patent application Ser. No. 13/042,378, entitled LIGHTING FIXTURE, the disclosure of which is incorporated herein by reference in its entirety.

FIELD OF THE DISCLOSURE

The present disclosure relates to lighting fixtures, and in particular to a heat transfer bracket for a lighting fixture.

BACKGROUND

In recent years, a movement has gained traction to replace incandescent light bulbs with lighting fixtures that employ more efficient lighting technologies. One such technology that shows tremendous promise employs light emitting diodes (LEDs). Compared with incandescent bulbs, LED-based light fixtures are much more efficient at converting electrical energy into light and are longer lasting, and as a result, lighting fixtures that employ LED technologies are expected to replace incandescent bulbs in residential, commercial, and industrial applications.

Unlike incandescent bulbs that operate by subjecting a filament to a desired current, LED-based lighting fixtures require control electronics to drive one or more LEDs. The control electronics includes a power supply and circuitry to provide the pulse streams or other signals that are required to drive the one or more LEDs in a desired fashion. While much more efficient than incandescent bulbs, the control electronics and the LEDs of the lighting fixture will emit a certain amount of heat, which should be efficiently dissipated to avoid damaging or reducing the operating life of the control electronics or the LEDs.

Since the control electronics and the LEDs of an LED-based lighting fixture are often mounted in such a way to allow the LED-based lighting fixture to replace either an incandescent light bulb or a lighting fixture that is compatible with an incandescent bulb, the control electronics and LEDs are often mounted in a location that is not conducive for heat dissipation. As such, there is a need to efficiently and effectively dissipate heat that is generated by the control electronics, the LEDs, or a combination thereof in LED-based lighting fixtures as well as other types of lighting fixtures that are faced with similar heat dissipation needs.

SUMMARY

The present disclosure relates to a heat transfer bracket that is configured to mount to a lighting fixture, which includes a heat spreading structure that is formed from a material that efficiently conducts heat and a light source and control electronics that are thermally coupled to the heat spreading structure. The heat transfer bracket includes a base that is thermally coupled to the heat spreading structure of the lighting fixture and multiple petals that extend from the base, wherein heat generated from the light source and control electronics is transferred to the heat spreading structure and from the heat spreading structure to the base of the heat transfer bracket. The heat is then further transferred along the plurality of petals.

In select embodiments, the lighting fixture with the attached heat transfer bracket is configured to mount within a recessed can assembly, which provides an opening that leads to an interior cavity with an interior surface. The petals are configured to spring radially inward and press against the interior surface of the recessed can assembly when the lighting fixture is placed in the interior cavity such that the heat transferred along the plurality of petals is further transferred to the recessed can assembly. The petals may also provide a mechanism for holding the lighting fixture in the recessed can assembly.

In select embodiments, the heat spreading structure may take the form of a cup that has a bottom panel, a rim, and at least one side wall extending between the bottom panel and the rim. The light source is coupled inside the heat spreading cup to the bottom panel and configured to emit light in a forward direction through an opening formed by the rim. The light source and the associated control electronics may be thermally coupled to the bottom panel such that heat generated by the light source during operation is transferred radially outward along the bottom panel toward the heat transfer bracket. The heat transfer bracket may be attached to the heat spreading structure at virtually any point.

The lighting fixture may optionally include a lens assembly and a reflector. The lens assembly is coupled to the heat spreading cup and covers the opening provided by the rim. The reflector has a body extending between a smaller opening, which is substantially adjacent and open to the light emitting element of the light source, and a larger opening that is biased toward the opening formed by the rim. To control the light source, a control electronics module may be coupled to an exterior surface of the bottom panel.

Those skilled in the art will appreciate the scope of the disclosure and realize additional aspects thereof after reading the following detailed description in association with the accompanying drawings.

BRIEF DESCRIPTION OF THE DRAWINGS

The accompanying drawings incorporated in and forming a part of this specification illustrate several aspects of the disclosure, and together with the description serve to explain the principles of the disclosure.

The accompanying drawings incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure and the accompanying claims.

It will be understood that relative terms such as "front," "forward," "rear," "below," "above," "upper," "lower," "horizontal," or "vertical" may be used herein to describe a relationship of one element, layer or region to another element, layer or region as illustrated in the figures. It will be understood that these terms are intended to encompass different orientations of the device in addition to the orientation depicted in the figures.

The present disclosure is related to a heat transfer bracket, which is configured to be mounted to a lighting fixture and functions to dissipate heat generated by the lighting fixture to a recessed can assembly or like structure. Prior to delving into the details of the heat transfer bracket, an overview is provided of an exemplary lighting fixture to which the heat transfer bracket may be mounted. Providing the overview of the exemplary lighting fixture prior to describing the heat transfer bracket gives context to the environment in which the heat transfer bracket is used. Notably, the exemplary lighting fixture is merely one example of a lighting fixture on which the heat transfer bracket of the present disclosure may be employed, and is used primarily to facilitate a comprehensive disclosure with regard to the heat transfer bracket. The portion of the disclosure related to the exemplary lighting fixture begins immediately below under the heading "OVERVIEW OF EXEMPLARY LIGHTING FIXTURE" and the portion of the disclosure related to the heat transfer bracket beings under the heading "HEAT TRANSFER BRACKET"

Overview of Exemplary Lighting Fixture

Figure 1:
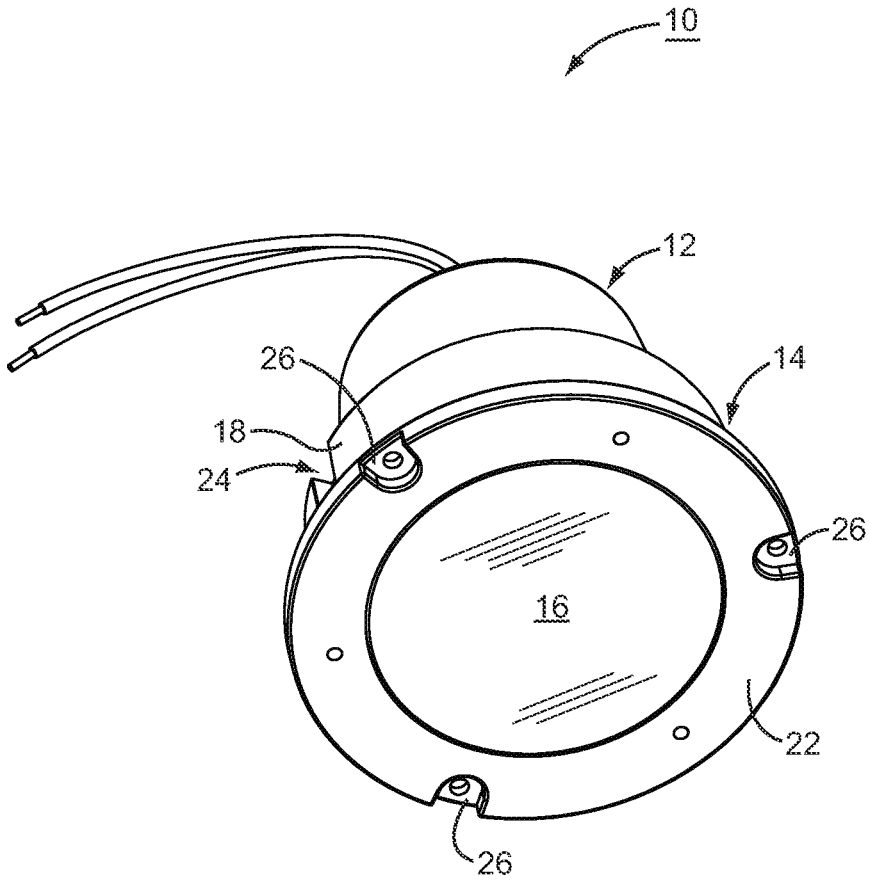
FIG. 1 is an isometric view of the front of the lighting fixture according to one embodiment of the disclosure.
Figure 2:
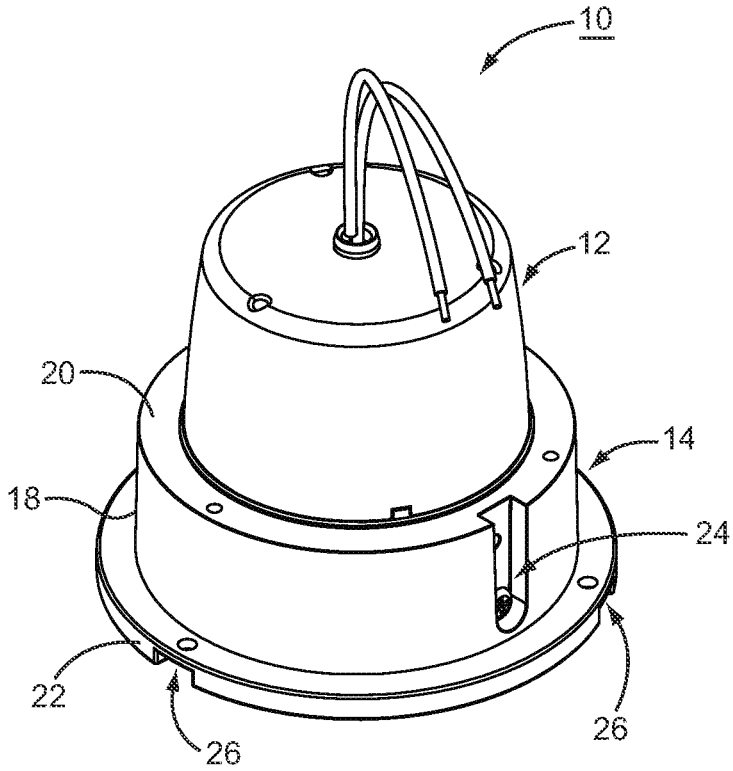
FIG. 2 is an isometric view of the back of the lighting fixture of FIG. 1.
Figure 3:
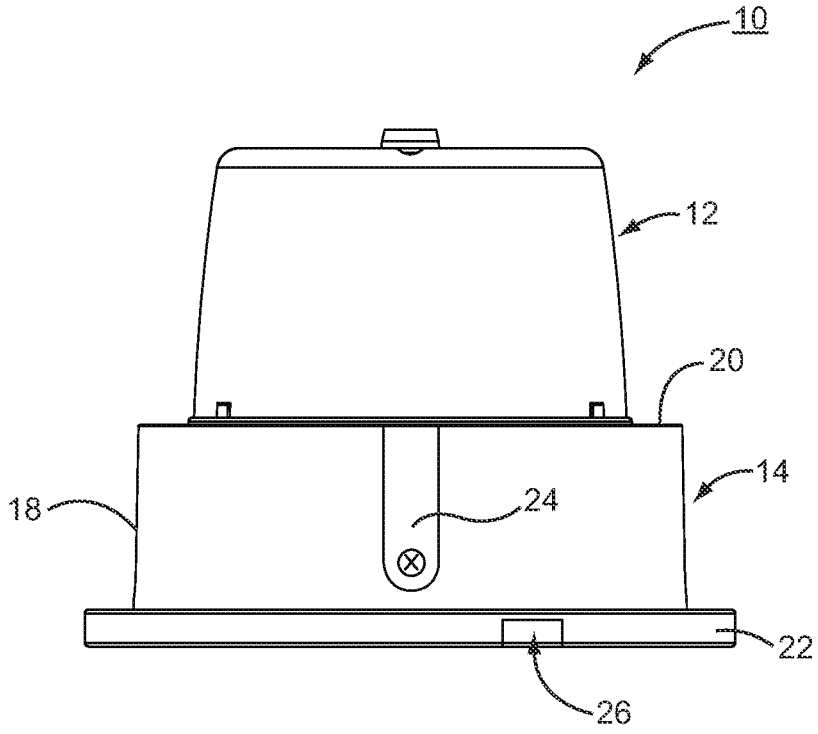
FIG. 3 is a side plan view of the lighting fixture of FIG. 1.

With reference to FIGS. 1-3, an exemplary lighting fixture 10 on which a heat transfer bracket of the present disclosure may be mounted is illustrated. As shown, the lighting fixture 10 includes a control module 12, a heat spreading cup 14, and a lens assembly 16. A light source (not shown), which will be described in detail further below, is mounted inside the heat spreading cup 14 and is oriented such that light is emitted from the heat spreading cup 14 through the lens assembly 16. The electronics (not shown) that are required to power and drive the light source are provided, at least in part, by the control module 12. While the lighting fixture 10 is envisioned to be used predominantly in 4, 5, and 6 inch recessed lighting applications for industrial, commercial, and residential applications, those skilled in the art will recognize the concepts disclosed herein are applicable to virtually any size and application.

The lens assembly 16 may include one or more lenses that are made of clear or transparent materials, such as polycarbonate or acrylic. The lens assembly 16 may include a diffuser for diffusing the light emanated from the light source and exiting the heat spreading cup 14 via the lens assembly 16. Further, the lens assembly 16 may also be configured to shape or direct the light exiting the heat spreading cup 14 via the lens assembly 16 in a desired manner.

The control module 12 and the heat spreading cup 14 may be integrated and provided by a single structure. Alternatively, the control module 12 and the heat spreading cup 14 may be modular wherein different sizes, shapes, and types of control modules 12 may be attached, or otherwise connected, to the heat spreading cup 14 and used to drive the light source provided therein.

The heat spreading cup 14 is made of a material that provides good thermal conductivity, such as metal, ceramic, or the like. In the disclosed embodiment, the heat spreading cup 14 is formed from aluminum, but other metals, or thermally conductive materials, are applicable. Lighting fixtures, such as the illustrated lighting fixture 10, are particularly beneficial for recessed lighting applications wherein most if not all of the lighting fixture 10 is recessed into a cavity within a wall, ceiling, cabinet, or like structure. Heat generated by the light source or electronics of the control module 12 is often trapped within the cavity. After prolonged operation, even an efficient lighting fixture 10 can cause sufficient heat to be trapped in the cavity to cause damage to the lighting fixture 10 itself or to its surroundings.

Historically, fixture designers have placed heat sinks near the rear of lighting fixtures in an effort to transfer heat away from the light source or control electronics. Unfortunately, transferring heat toward the rear of the lighting fixtures effectively transfers the heat directly into the cavity in which the lighting fixture is mounted. As a result, the cavity heats up to a point where the heat sink no longer functions to transfer heat from the control electronics or light source, and damage to the lighting fixture ensues.

Instead of directing heat transfer toward the rear of the lighting fixture 10 and into the cavity in which the lighting fixture 10 is mounted, the lighting fixture 10 employs the heat spreading cup 14 to direct heat transfer more toward the front of the lighting fixture 10. Even when mounted into a cavity, the front of the lighting fixture 10 is either exposed to ambient, or in select embodiments, coupled directly or indirectly to another structure that aids in heat dissipation. By directing heat transfer toward the front of the lighting fixture 10, the amount of heat that would otherwise be directed into the cavity in which the lighting fixture 10 is mounted is significantly reduced. By reducing the amount of heat directed toward the rear of the lighting fixture 10, the performance and longevity of the lighting fixture 10 may be enhanced, the number of acceptable mounting conditions and applications may be increased, the cost of the lighting fixture 10 may be reduced by being able to use less expensive components, or any combination thereof.

In the illustrations of FIGS. 1-3, the heat spreading cup 14 is cup-shaped and includes a side wall 18 that extends between a bottom panel 20 at the rear of the heat spreading cup 14 and a rim, which may be provided by an annular flange 22, at the front of the heat spreading cup 14. One or more elongated slots 24 may be formed in the outside surface of the side wall 18. As illustrated, there are two elongated slots 24, which extend parallel to a central axis of the lighting fixture 10 from the rear surface of the bottom panel 20 toward, but not completely to, the annular flange 22. The elongated slots 24 may be used for a variety of purposes, such as providing a channel for a grounding wire that is connected to the heat spreading cup 14 inside the elongated slot 24, connecting additional elements to the lighting fixture 10, or as described further below, securely attaching the lens 16 to the heat spreading cup 14.

The annular flange 22 may include one or more mounting recesses 26 in which mounting holes are provided. The mounting holes may be used for mounting the lighting fixture 10 to a mounting structure or for mounting accessories to the lighting fixture 10. The mounting recesses 26 provide for counter-sinking the heads of bolts, screws, or other attachment means below or into the front surface of the annular flange 22.

Figure 4:
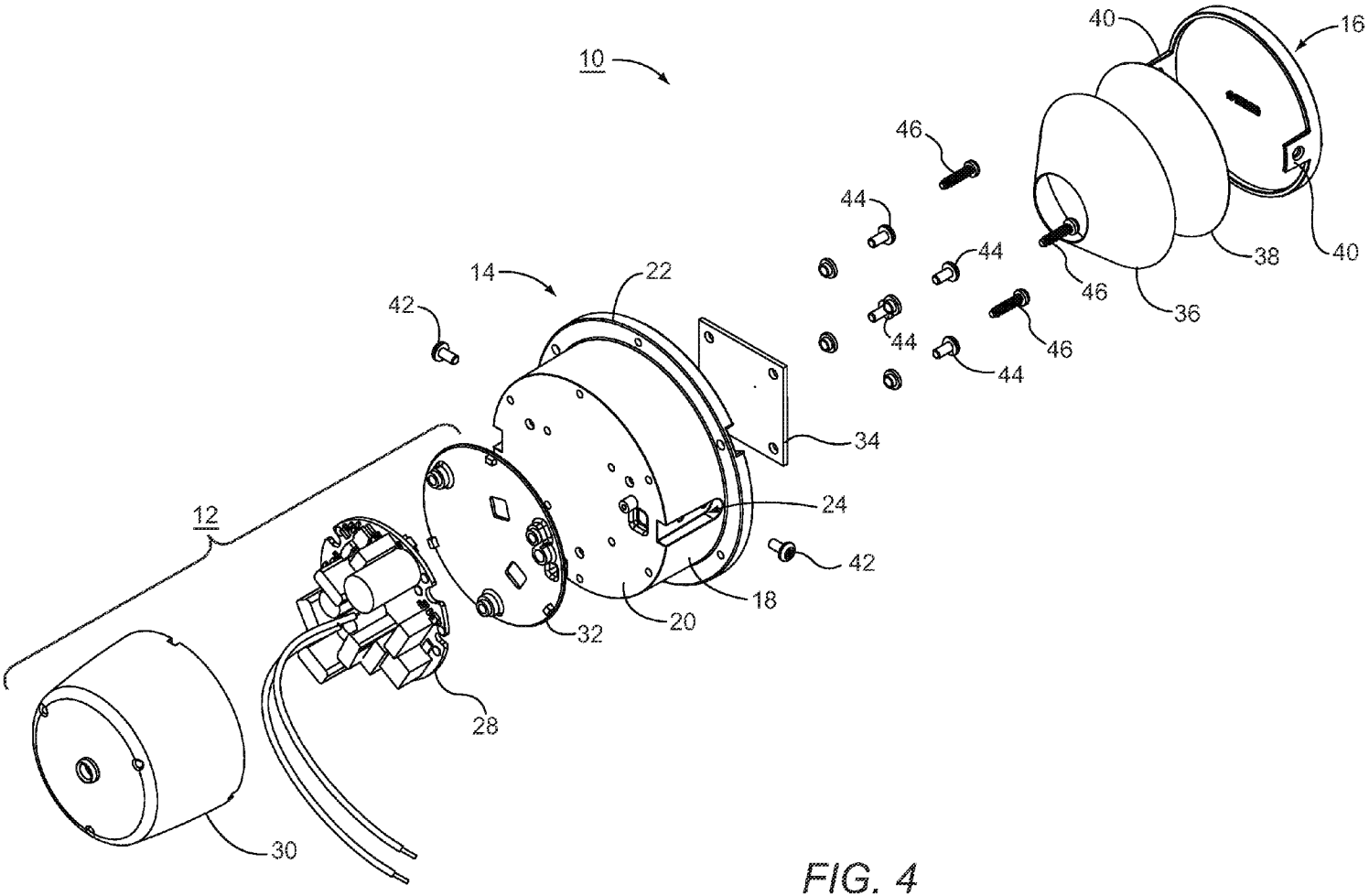
FIG. 4 is an exploded isometric view of the lighting fixture of FIG. 1.

With reference to FIG. 4, an exploded view of the lighting fixture 10 of FIGS. 1-3 is provided. As illustrated, the control module 12 includes control module electronics 28, which are encapsulated by a control module housing 30 and a control module cover 32. The control module housing 30 is cup-shaped and sized sufficiently to receive the control module electronics 28. The control module cover 32 provides a cover that extends substantially over the opening of the control module housing 30. Once the control module cover 32 is in place, the control module electronics 28 are contained within the control module housing 30 and the control module cover 32. The control module 12 is, in the illustrated embodiment, mounted to the rear surface of the bottom panel 20 of the heat spreading cup 14.

The control module electronics 28 may be used to provide all or a portion of power and control signals necessary to power and control the light source 34, which may be mounted on the front surface of the bottom panel 20 of the heat spreading cup 14. Aligned holes or openings in the bottom panel 20 of the heat spreading cup 14 and the control module cover 32 are provided to facilitate an electrical connection between the control module electronics 28 and the light source 34. In the illustrated embodiment, the light source 34 is solid state and employs one or more light emitting diodes (LEDs) and associated electronics, which are mounted to a printed circuit board (PCB) to generate light at a desired magnitude and color temperature. The LEDs are mounted on the front side of the PCB while the rear side of the PCB is mounted to the front surface of the bottom panel 20 of the heat spreading cup 14 directly or via a thermally conductive pad (not shown). The thermally conductive pad has a low thermal resistivity, and therefore, efficiently transfers heat that is generated by the light source 34 to the bottom panel 20 of the heat spreading cup 14. While an LED-based light source is the focus herein, other lighting technologies, such as but not limited to high-intensity discharge (HID) bulbs, readily benefit from the disclosed concepts.

While various mounting mechanisms are available, the illustrated embodiment employs four bolts 44 to attach the PCB of the light source 34 to the front surface of the bottom panel 20 of the heat spreading cup 14. The bolts 44 screw into threaded holes provided in the front surface of the bottom panel 20 of the heat spreading cup 14. Three bolts 46 are used to attach the heat spreading cup 14 to the control module 12. In this particular configuration, the bolts 46 extend through corresponding holes provided in the heat spreading cup 14 and the control module cover 32 and screw into threaded apertures (not shown) provided just inside the rim of the control module housing 30. As such, the bolts 46 effectively sandwich the control module cover 32 between the heat spreading cup 14 and the control module housing 30.

A reflector cone 36 resides within the interior chamber provided by the heat spreading cup 14. In the illustrated embodiment, the reflector cone 36 has a conical wall that extends between a larger front opening and a smaller rear opening. The larger front opening resides at and substantially corresponds to the dimensions of front opening in the heat spreading cup 14 that corresponds to the front of the interior chamber provided by the heat spreading cup 14. The smaller rear opening of the reflector cone 36 resides about and substantially corresponds to the size of the LED or array of LEDs provided by the light source 34. The front surface of the reflector cone 36 is generally, but not necessarily, highly reflective in an effort to increase the overall efficiency of the lighting fixture 10. In one embodiment, the reflector cone 36 is formed from metal, paper, a polymer, or a combination thereof. In essence, the reflector cone 36 provides a mixing chamber for light emitted from the light source 34, and as described further below, may be used to help direct or control how the light exits the mixing chamber through the lens assembly 16.

Figure 5:
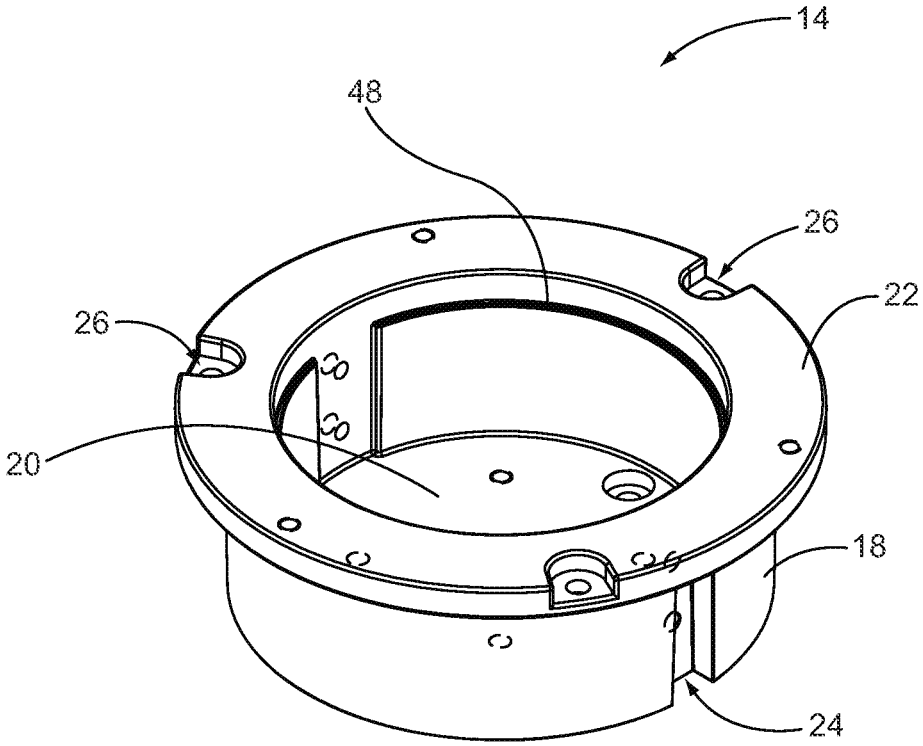
FIG. 5 is an isometric view of the front of the heat spreading cup of the lighting fixture of FIG. 1.
Figure 6:
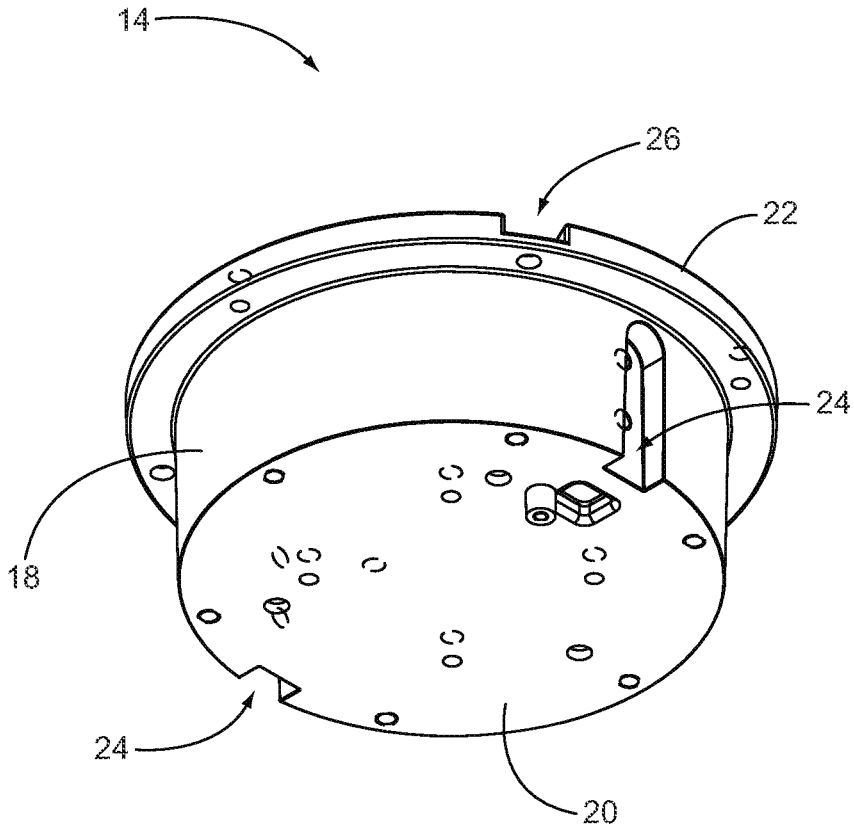
FIG. 6 is an isometric view of the rear of the heat spreading cup of the lighting fixture of FIG. 1.

When assembled, the lens assembly 16 is mounted on or to the annular flange 22 and may be used to hold the reflector cone 36 in place within the interior chamber of the heat spreading cup 14 as well as hold additional lenses and one or more diffusers 38 in place. In the illustrated embodiment, the lens assembly 16 and the diffuser 38 generally correspond in shape and size to the front opening of the heat spreading cup 14 and are mounted such that the front surface of the lens is substantially flush with the front surface of the annular flange 22. As shown in FIGS. 5 and 6, a recess 48 is provided on the interior surface of the side wall 18 and substantially around the opening of the heat spreading cup 14. The recess 48 provides a ledge on which the diffuser 38 and the lens assembly 16 may rest inside the heat spreading cup 14. The recess 48 may be sufficiently deep such that the front surface of the lens assembly 16 is flush with the front surface of the annular flange 22.

Returning to FIG. 4, the lens assembly 16 may include tabs 40, which extend rearward from the outer periphery of the lens assembly 16. The tabs 40 may slide into corresponding channels on the interior surface of the side wall 18 (see FIGS. 5 and 7). The channels are aligned with corresponding elongated slots 24 on the exterior of the side wall 18. The tabs 40 have threaded holes that align with holes provided in the grooves and elongated slots 24. When the lens assembly 16 resides in the recess 48 at the front opening of the heat spreading cup 14, the holes in the tabs 40 will align with the holes in the elongated slots 24. Bolts 42 may be inserted through the holes in the elongated slots and screwed into the holes provided in the tabs 40 to affix the lens assembly 16 to the heat spreading cup 14. When the lens assembly 16 is secured, the diffuser 38 is sandwiched between the lens assembly and the recess 48, and the reflector cone 36 is contained between the diffuser 38 and the light source 34.

The degree and type of diffusion provided by the diffuser 38 may vary from one embodiment to another. Further, color, translucency, or opaqueness of the diffuser 38 may vary from one embodiment to another. Diffusers 38 are typically formed from a polymer or glass, but other materials are viable. Similarly, the lens assembly 16 includes a planar lens, which generally corresponds to the shape and size of the diffuser 38 as well as the front opening of the heat spreading cup 14. As with the diffuser 38, the material, color, translucency, or opaqueness of the lens or lenses provided by the lens assembly 16 may vary from one embodiment to another. Further, both the diffuser 38 and the lens assembly 16 may be formed from one or more materials or one or more layers of the same or different materials. While only one diffuser 38 and one lens (in lens assembly 16) are depicted, the lighting fixture 10 may have multiple diffusers 38 or lenses; no diffuser 38; no lens; or an integrated diffuser and lens (not shown) in place of the illustrated diffuser 38 and lens assembly 16.

Figure 7:
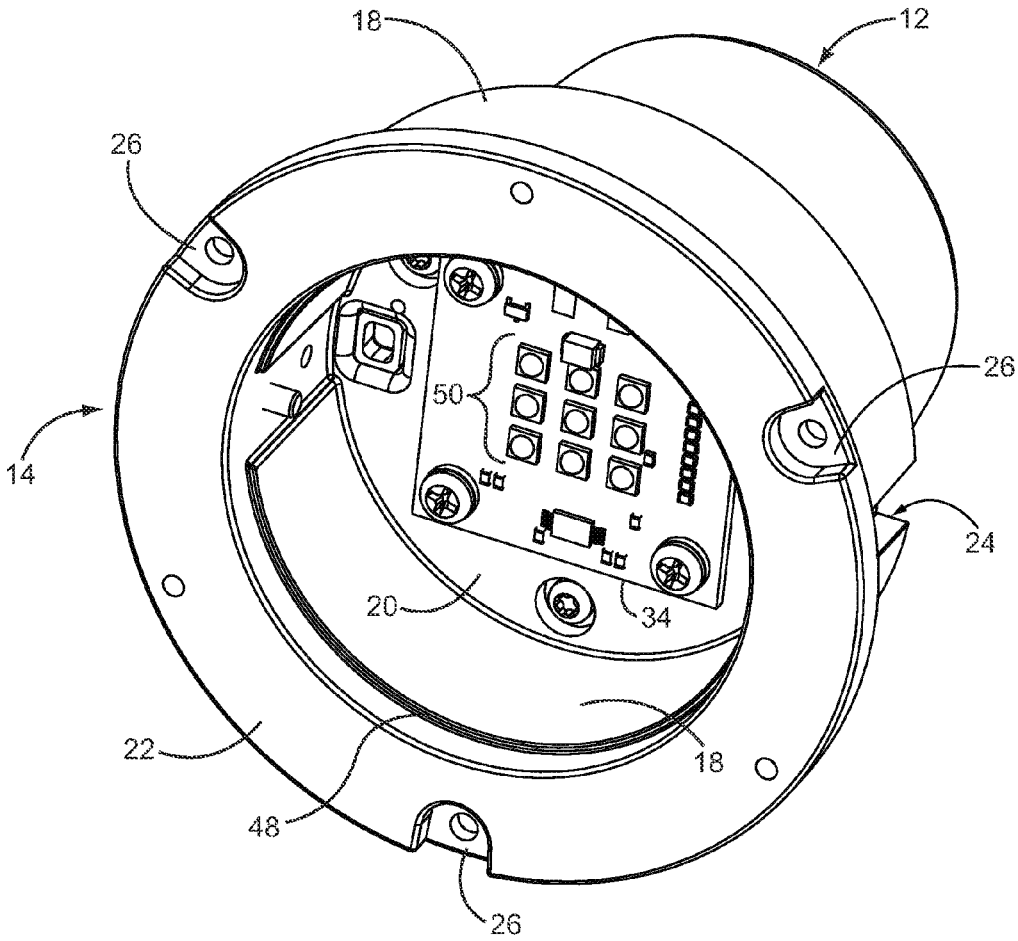
FIG. 7 is an isometric view of the front of the lighting fixture of FIG. 1 without the lens assembly, diffuser, and reflector.

For LED-based applications, the light source 34 provides an array of LEDs 50, as illustrated in FIG. 7. FIG. 7 illustrates a front isometric view of the lighting fixture 10, with the lens assembly 16, diffuser 38, and reflector cone 36 removed. Light emitted from the array of LEDs 50 is mixed inside the mixing chamber formed by the reflector cone 36 (not shown) and directed out through the lens assembly 16 in a forward direction to form a light beam. The array of LEDs 50 of the light source 34 may include LEDs 50 that emit different colors of light. For example, the array of LEDs 50 may include both red LEDs 50 that emit red light and blue-shifted green LEDs 50 that emit bluish-green light, wherein the red and bluish-green light is mixed to form "white" light at a desired color temperature. For a uniformly colored light beam, relatively thorough mixing of the light emitted from the array of LEDs 50 is desired. Both the mixing chamber provided by the reflector cone 36 and the diffuser 38 play a role in mixing the light emanated from the array of LEDs 50 of the light source 34.

Certain light rays, which are referred to as non-reflected light rays, emanate from the array of LEDs 50 and exit the mixing chamber through the diffuser 38 and lens assembly 16 without being reflected off of the interior surface of the reflector cone 36. Other light rays, which are referred to as reflected light rays, emanate from the array of LEDs of the light source 34 and are reflected off of the front surface of the reflector cone 36 one or more times before exiting the mixing chamber through the diffuser 38 and lens assembly 16. With these reflections, the reflected light rays are effectively mixed with each other and at least some of the non-reflected light rays within the mixing chamber before exiting the mixing chamber through the diffuser 38 and the lens assembly 16.

As noted above, the diffuser 38 functions to diffuse, and as result mix, the non-reflected and reflected light rays as they exit the mixing chamber, wherein the mixing chamber and the diffuser 38 provide sufficient mixing of the light emanated from the array of LEDs 50 of the light source 34 to provide a light beam of a consistent color. In addition to mixing light rays, the diffuser 38 may be designed and the reflector cone 36 shaped in a manner to control the relative concentration and shape of the resulting light beam that is projected from the lighting fixture 10. For example, a first lighting fixture 10 may be designed to provide a concentrated beam for a spotlight, wherein another may be designed to provide a widely dispersed beam for a floodlight.

Figure 8:
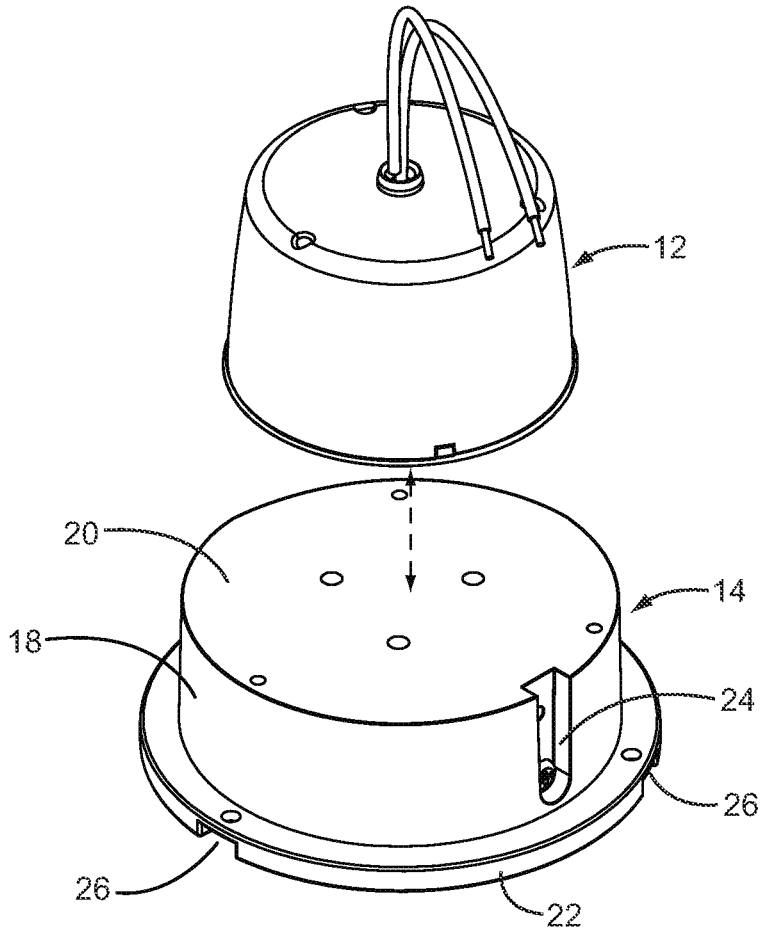
FIG. 8 illustrates the separation of the control module and heat spreading cup of the lighting fixture.

In select embodiments, the lighting fixture 10 is designed to work with different types of control modules 12 wherein different control modules 12 may interchangeably attach to the heat spreading cup 14, and can be used to drive the light source 34 provided in the heat spreading cup 14. As illustrated in FIG. 8, the control module 12 is readily attached to and detached from the heat spreading cup 14 wherein plugs or apertures are provided in each device to facilitate the necessary electrical connection between the two devices. As such, different manufactures are empowered to design and manufacture control modules 12 for another manufacture's heat spreading cup 14 and light source 34 assembly, and vice versa. Further, different sizes, shapes, and sizes of control modules 12 may be manufactured for a given heat spreading cup 14 and light source 34 assembly, and vice versa.

Heat Transfer Bracket

Figure 9A:
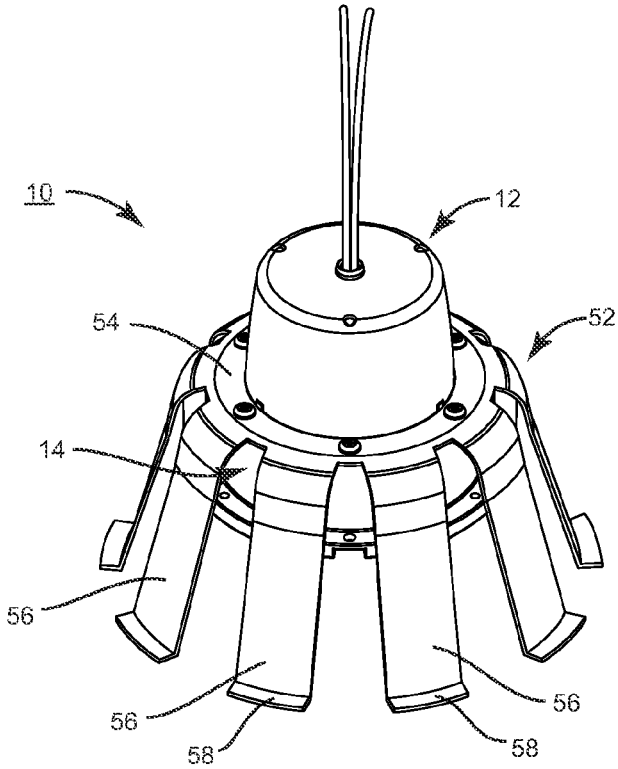
FIGS. 9A and 9B are isometric and side plan views of a lighting fixture with a heat transfer bracket according to one embodiment of the disclosure.
Figure 9B:
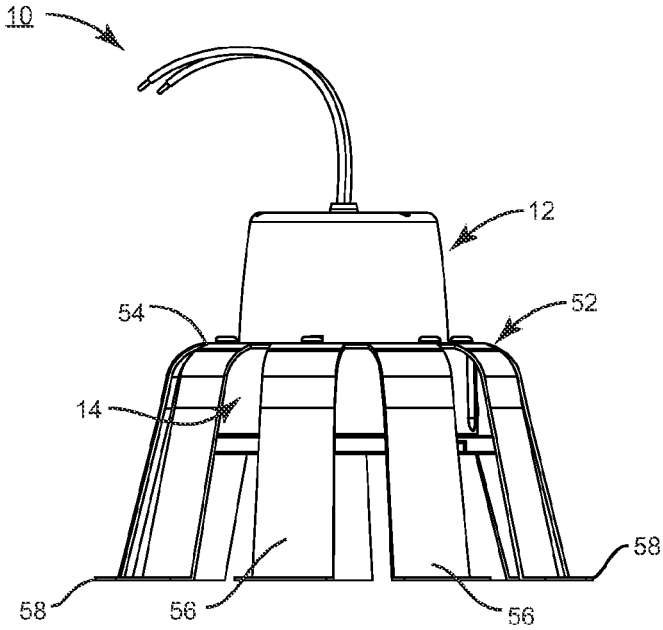

FIGS. 9A and 9B illustrate a lighting fixture 10 having a heat transfer bracket 52 according to one embodiment of the disclosure. The heat transfer bracket is 52 is designed to further aid the transfer of heat away from the control module electronics 28 and the light source 34. In particular, the heat transfer bracket 52 can transfer heat from the heat spreading cup 14, or like heat spreading structure, to a recessed can assembly within which the lighting fixture 10 is mounted. Further, the heat transfer bracket 52 may also provide a mechanism by which the lighting fixture 10 is attached to or within the can assembly. An example of how a lighting fixture 10 equipped with a heat transfer bracket 52 is mounted in a can assembly is provided after a description of the heat transfer bracket 52.

In this embodiment, the heat transfer bracket includes a base 54, which is designed to be attached to the heat spreading cup 14. The base 54 in this example is a relatively flat annular ring and is shown bolted to the rear surface of the bottom panel 20 of the heat spreading cup 14. The control module housing 30 of the control module 12 extends through an aperture formed by the base 54. From the base 54, a number of elongated petals 56 extend. The petals 56 initially extend radially outward from the base 54 and then linearly extend in a forward direction along the central axis of the lighting fixture 10.

While the petals 56 may run substantially parallel to the central axis, in the illustrated embodiment the petals 56 are biased radially outward from the central axis. Further, tabs 58 are formed on the distal ends of the petals 56. The tabs 58 may be substantially perpendicular to the linear portions of the petals 56 and extend outward from the distal ends of the petals 56. The heat transfer bracket 52 is made of a material that provides good thermal conductivity, such as metal, ceramic, or the like. In the disclosed embodiment, the heat transfer bracket 52 is formed from aluminum, but other metals, or thermally conductive materials, are applicable.

Figure 10A:
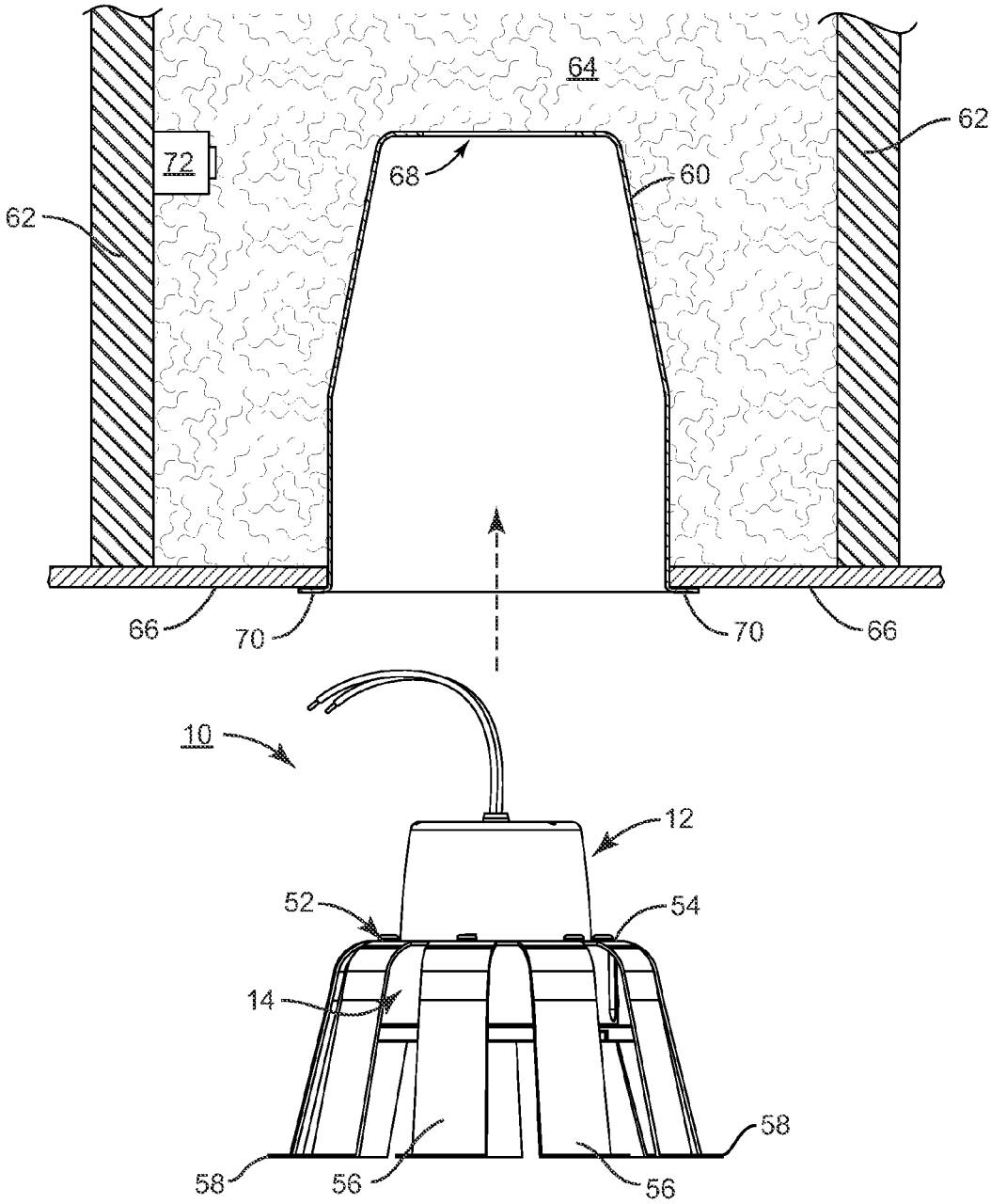
FIG. 10A illustrates a lighting fixture with a heat transfer bracket prior to being inserted into a recessed can assembly according to one embodiment of the disclosure.

With reference to FIG. 10A, a cross-section of a conventional ceiling structure, in which a recessed can assembly 60 is mounted, is illustrated. The ceiling structure includes ceiling joists 62, insulation 64, and a drywall ceiling surface 66. The recessed can assembly 60 is shown extending through an aperture in the drywall ceiling surface 66 in conventional fashion. The top of the recessed can assembly 60 includes an aperture 68, and the bottom of the recessed can assembly 60 has an outward extending flange 70 that rests against a bottom surface of the drywall ceiling surface 66. The flange 70 forms a bottom opening through which a lighting fixture 10 is received.

Figure 10B:
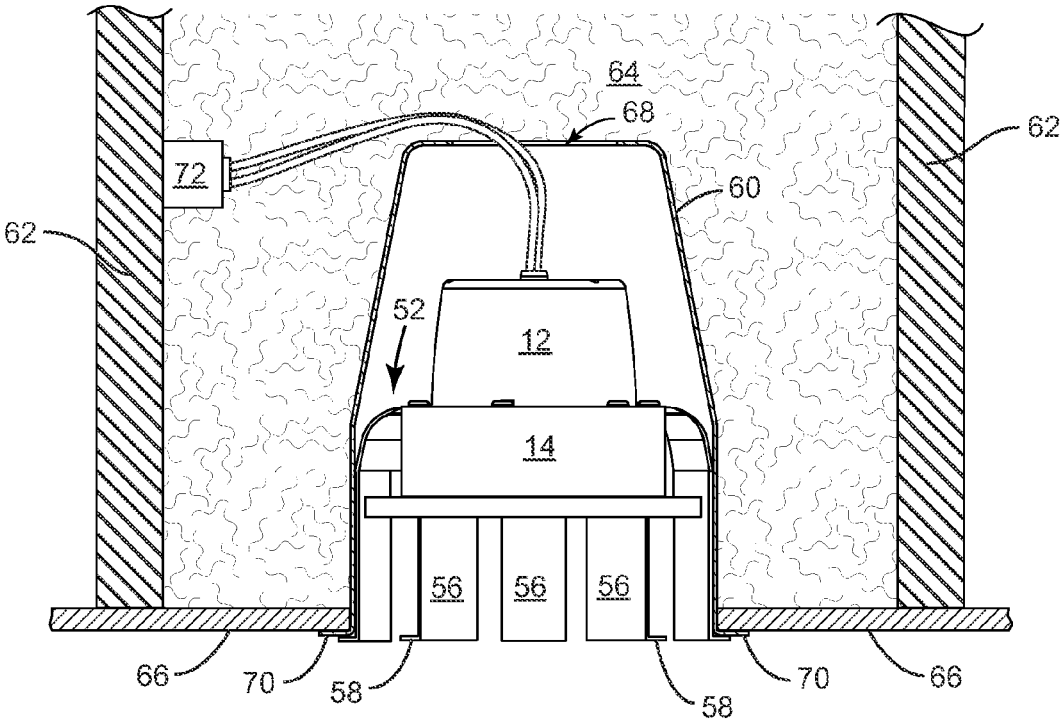
FIG. 10B illustrates the lighting fixture with a heat transfer bracket after being inserted into a recessed can assembly according to one embodiment of the disclosure.

The lighting fixture 10 with the heat transfer bracket 52 of FIGS. 9A and 9B is shown just below the bottom opening of the recessed can assembly 60. As shown in FIG. 10B, the heat transfer bracket 52 is sized to slide into the bottom opening of the recessed can assembly 60 in such a way that the distal ends of the petals 56 will deflect inward toward the central axis of the lighting fixture 10 as the lighting fixture 10 is slid into the recessed can assembly 60. In the illustrated embodiment, the linear portions of the petals 56 are substantially parallel with and rest evenly against the inside surface of the recessed can assembly 60 once the lighting fixture 10 is in place. When the lighting fixture 10 is inserted into the recessed can assembly 60, the petals 56 are sprung radially inward toward the central axis of the lighting fixture 10. Since the petals 56 are sprung radially inward when the recessed lighting fixture 10 is in position, the petals 56 may exert enough force against the inside surface of the recessed can assembly 60 such that the static friction between outside surface of the petals 56 and the inside surface of the recessed can assembly 60 is sufficient to hold the lighting fixture 10 in position without supplemental attachment mechanisms.

The tabs 58 at the distal ends of the petals 56 may act as stops that limit the distance to which the lighting fixture 10 can be inserted into the recessed can assembly 60. The tabs 58 are shown resting against the flange 70 of the recessed can assembly 60. An appropriate electrical box 72 or the like may provide power to the lighting fixture 10. To aid connection of power to the lighting fixture 10, a cable with a connector (not shown) may be provided to extend from the electrical box 72 and into the recessed can assembly 60 via the aperture 68. A mating connector (not shown) may be provided on the cable extending from the control module 12. As such, the respective cables may be connected to one another via the connectors prior to sliding the lighting fixture 10 into the recessed can assembly.

Figure 11:
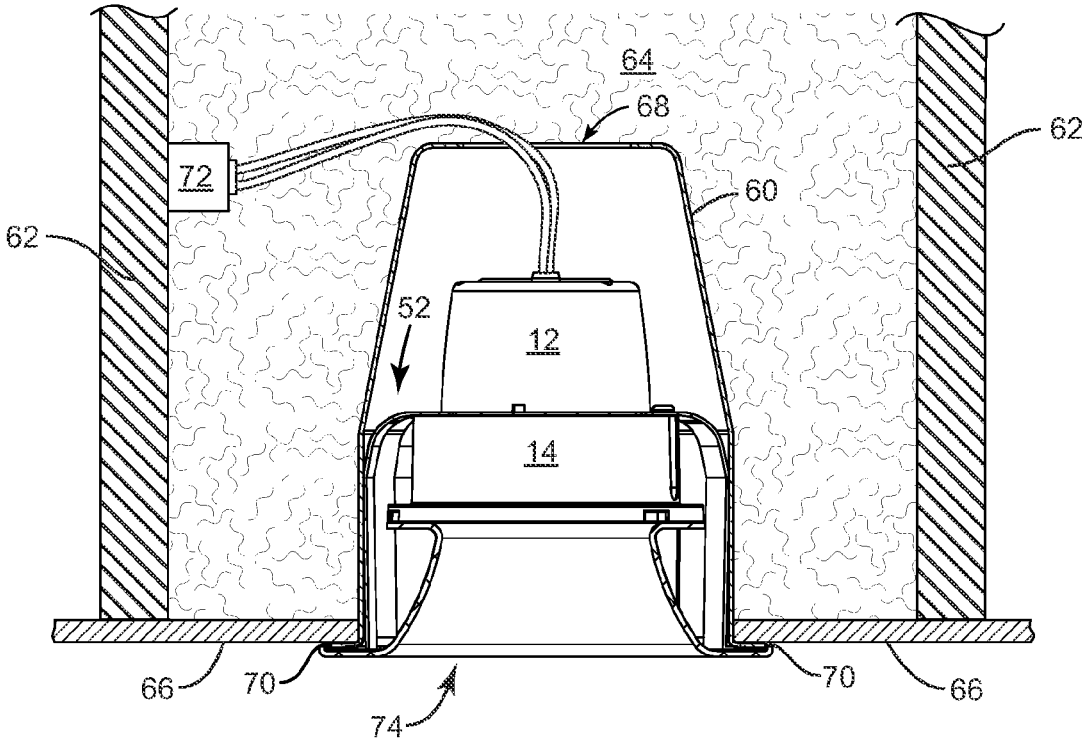
FIG. 11 illustrates the lighting fixture of FIGS. 10A and 10B with a trim assembly.

FIG. 11 illustrates a trim assembly 74 that is substantially conical in shape and may be used to provide a decorative trim, which hides the lighting fixture 10, the heat transfer bracket 52, the recessed can assembly 60, and the aperture in the drywall ceiling surface 66 from view. When viewed from below, only the exposed portion of the trim assembly 74 and the lens cover of the lighting fixture 10 are visible.

In operation, a large portion of the heat generated by the control module electronics 28 and the light source 34 is transferred to the bottom panel 20 of the heat spreading cup 14. Heat reaching the outer portion of the bottom panel 20 of the heat spreading cup 14 is then transferred to the heat transfer bracket 52 via the base 54. Heat may also be transferred to and forward along the side wall 18 of the heat spreading cup 14. The heat transferred to the base 54 of the heat transfer bracket 52 is transferred to the walls of the recessed can assembly 60 via the petals 56 and the tabs 58. As such, there is a substantial amount of surface area provided by the recessed can assembly 60, the heat transfer bracket 52, and in select embodiments, the heat spreading cup 14 to dissipate the heat generated by the control module electronics 28 and the light source 34. Notably, the heat spreading cup 14 may be implemented as a heat spreading structure without the side wall 18. However, the presence of the side wall 18 is useful in transferring additional heat toward the front of the lighting fixture 10. With the disclosed example, a significant amount, if not a majority, of the heat is transferred toward the front of the lighting fixture 10 via the heat spreading cup 14 and the heat transfer bracket 52, instead of being transferred to the rear of the lighting fixture 10 where it may be trapped within the cavity inside the recessed can assembly 60.

As noted, the heat spreading cup 14 is simply one example of a heat spreading structure that is capable of transferring heat from the control module electronics 28 and the light source 34 to the heat transfer bracket 52, and perhaps to another forward directed element, such as the side wall 18 of the heat spreading cup 14. The heat spreading structure may take various forms, such as a disk, rectangular plate, spherical member, conical member, or the like, and need not be "cup-shaped." Regardless of the configuration of the heat spreading structure, the heat transfer bracket 52 may be attached to the heat spreading structure at different locations using different attachment methods. Like the heat spreading structure, the heat transfer bracket 52 may also take various shapes. The following description provides various exemplary structures for the heat transfer brackets 52 and locations at which the heat transfer brackets 52 can be attached to the heat spreading cup 14. These examples are for illustration only and do not limit the scope of the disclosure or the claims that follow.

Figure 12A:
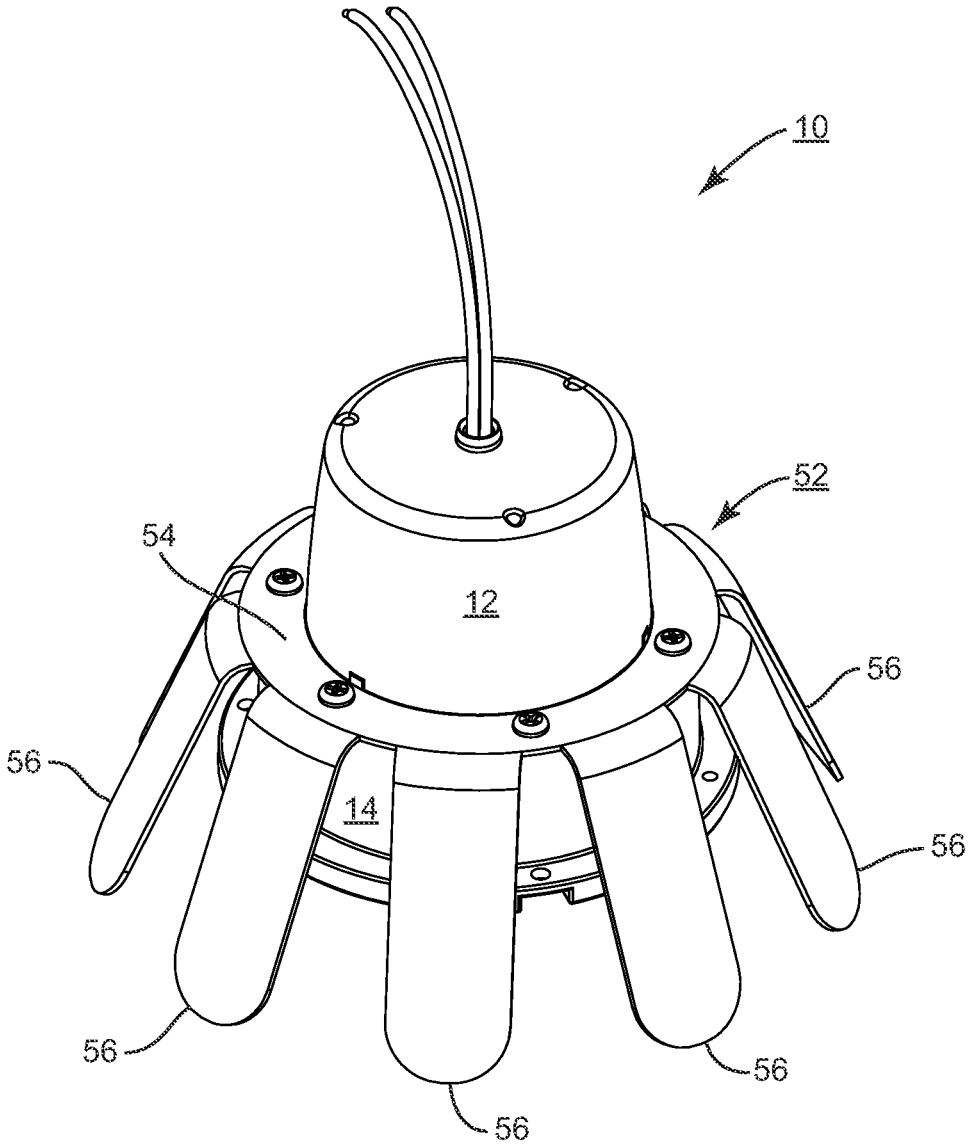
FIGS. 12A, 12B, and 12C are isometric, side plan, and top plan views of a lighting fixture with a heat transfer bracket according to one embodiment of the disclosure.
Figure 12B:
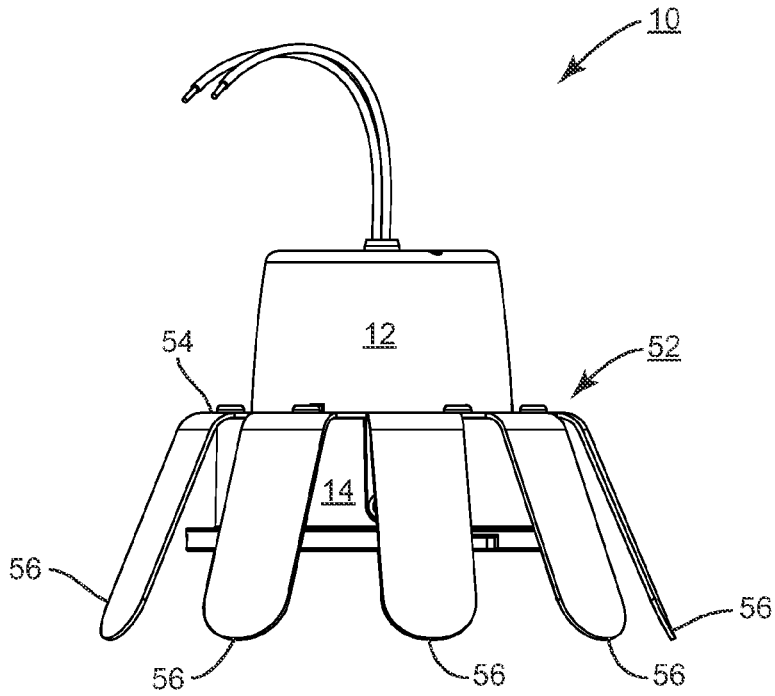
Figure 12C:
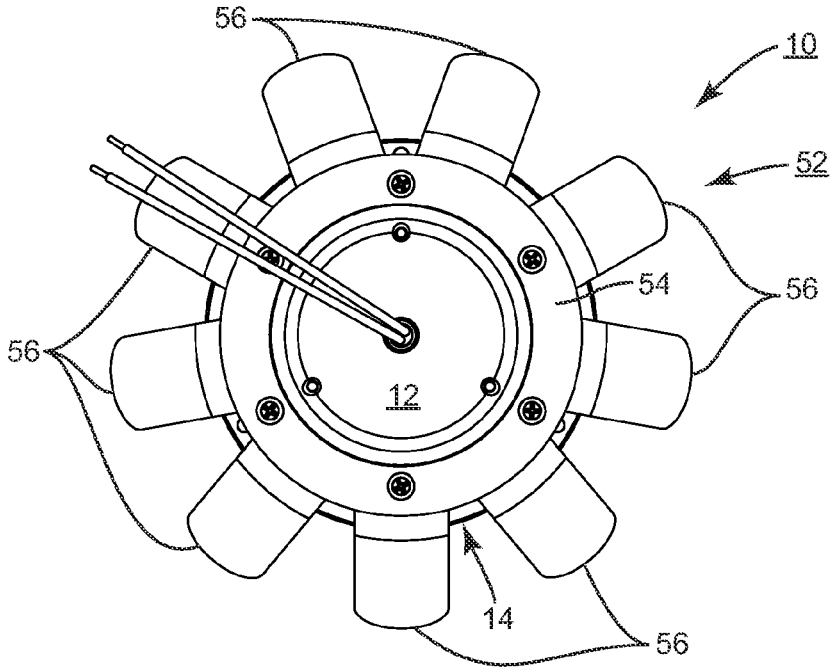

Returning to the embodiment of FIGS. 9A and 9B, the base 54 is configured to mount to the rear surface of the bottom panel 20 (FIGS. 2, 3, and 4) of the heat spreading cup 14. As such, the linear portions of the petals 56 of the heat transfer bracket 52 extend alongside and beyond the side wall 18 of the heat spreading cup 14. The embodiment of FIGS. 12A, 12B, and 12C have a similar configuration as that of FIGS. 9A and 9B, with the exception that the distal ends of the petals 56 are rounded and do not have tabs 58. While rounded distal ends are shown, other shapes are suitable. As with the prior embodiment, the petals 56 of the heat transfer bracket 52 extend alongside and beyond the side wall 18 of the heat spreading cup 14.

Figure 13A:
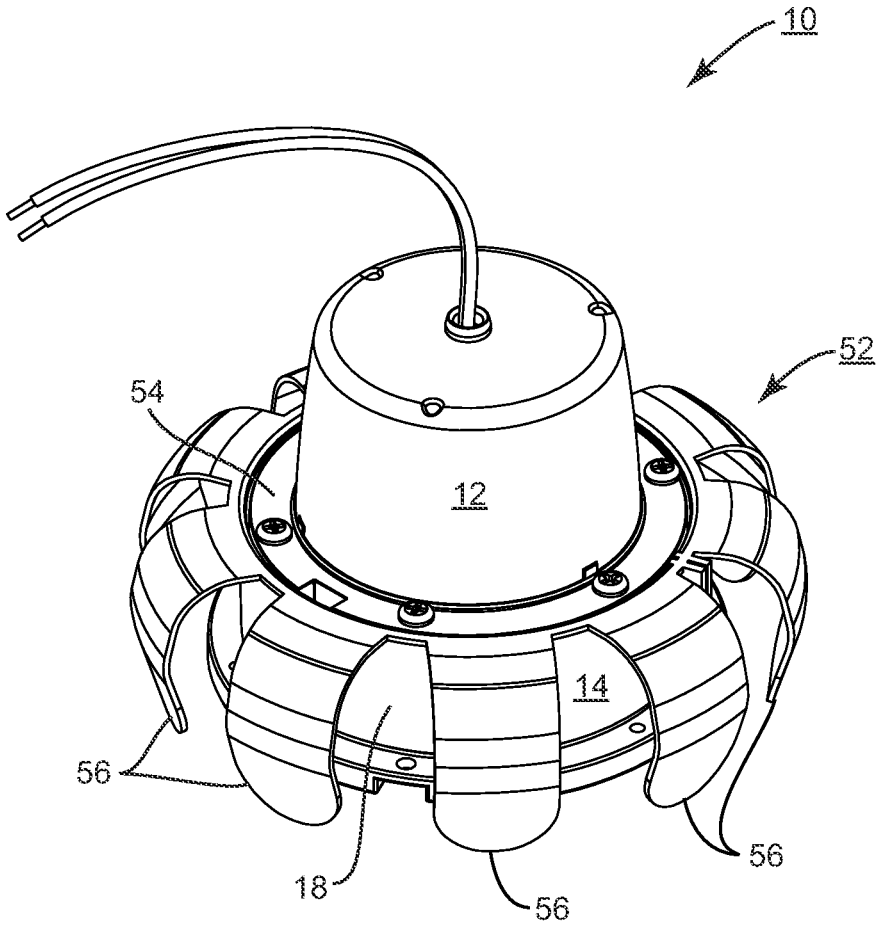
FIGS. 13A, 13B, and 13C are isometric, side plan, and top plan views of a lighting fixture with a heat transfer bracket according to one embodiment of the disclosure.
Figure 13B:
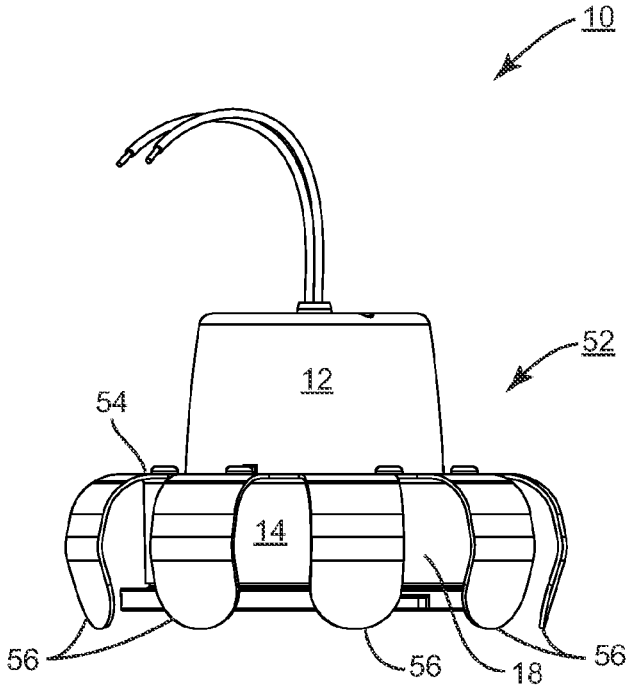
Figure 13C:
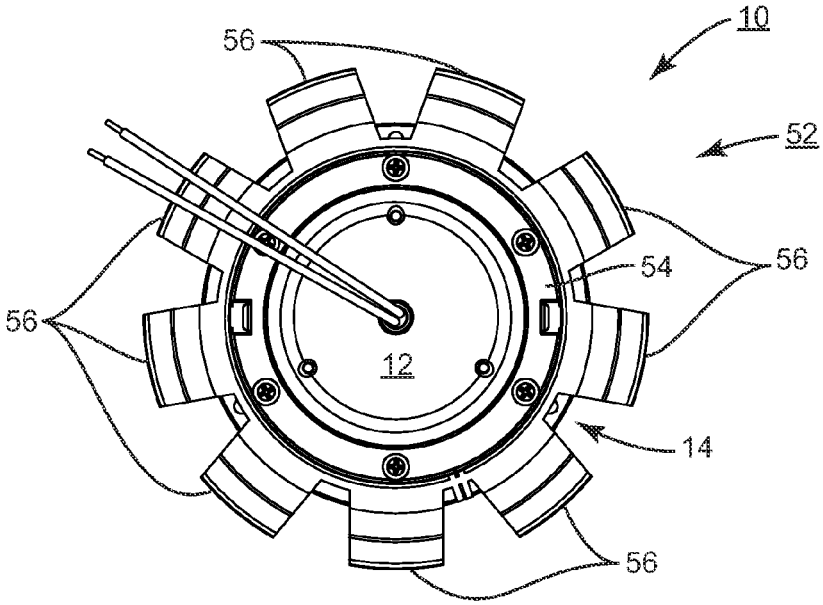

The embodiment of FIGS. 13A, 13B, and 13C includes a heat transfer bracket 52 that has substantially curved petals 56 as opposed to the substantially linear petals 56 of the prior embodiments. The base 54 of the heat transfer bracket 52 is mounted to the rear surface of the bottom panel 20 (FIGS. 2, 3, and 4) of the heat spreading cup 14. The petals 56 of the embodiment of FIGS. 13A, 13B, and 13C initially project outward from the base 54 and the central axis of the lighting fixture 10 and then curve back inward toward the central axis. Further, the petals 56 extend forward alongside and slightly beyond the side wall 18 of the heat spreading cup 14.

When a lighting fixture 10 with the heat transfer bracket 52 of FIGS. 13A, 13B, and 13C is inserted in the recessed can assembly 60, the petals 56 may spring inward toward the central axis. A central portion of the outside surface of each of the petals 56 will make contact with the inside surface of the recessed can assembly 60. These points of contact will provide heat transfer points from the heat transfer bracket 52 to the recessed can assembly 60, and in select embodiments, may provide sufficient static friction to hold the lighting fixture 10 in position without supplemental attachment mechanisms.

Figure 14A:
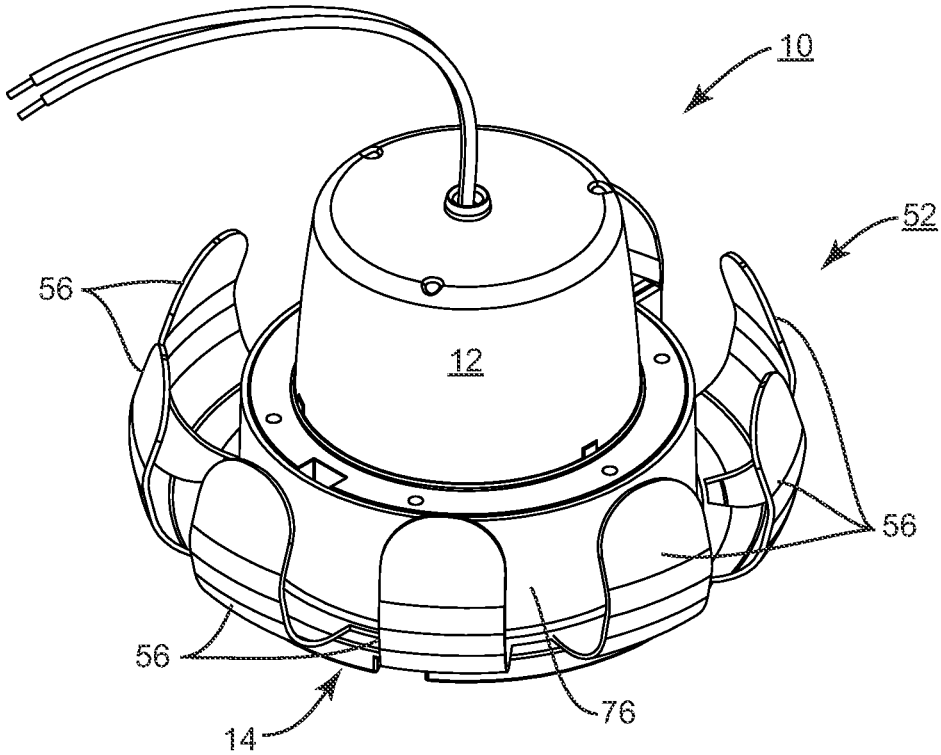
FIGS. 14A, 14B, and 14C are isometric, side plan, and top plan views of a lighting fixture with a heat transfer bracket according to one embodiment of the disclosure.
Figure 14B:
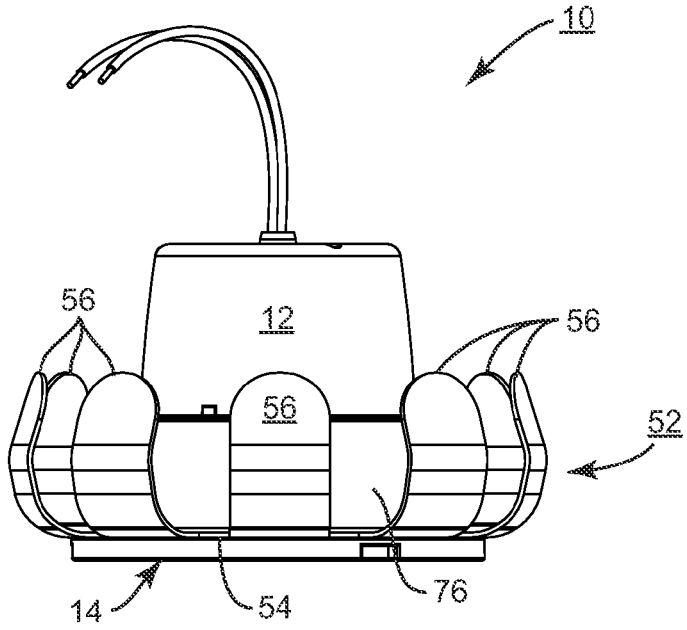
Figure 14C:
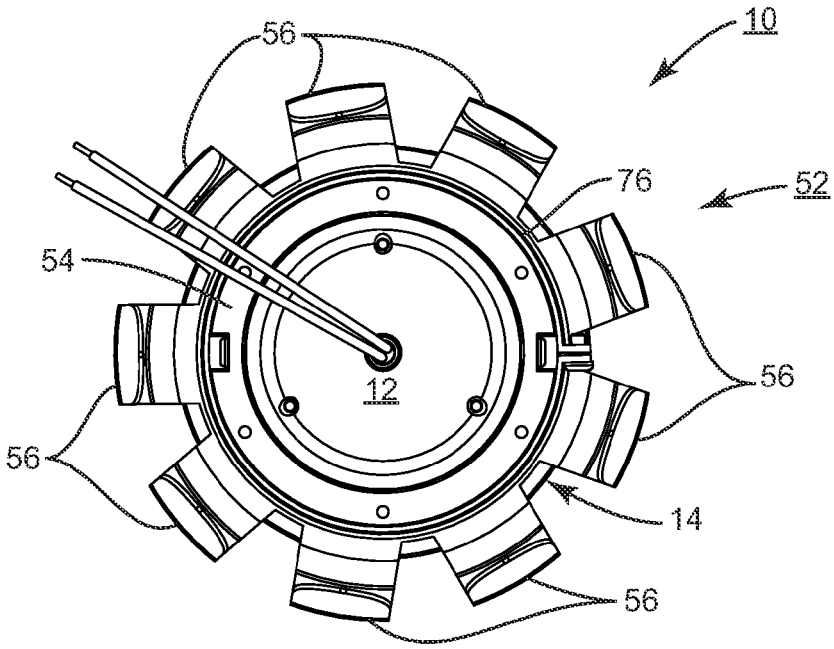

In the embodiment of FIGS. 14A, 14B, and 14C, the base (54) takes the form of a cylindrical sleeve 76 that has an inside diameter sized to fit snugly around the outside surface of the side wall 18 of the heat spreading cup 14. As such, the inside surface of the sleeve 76 is in contact with the outside surface of the side wall 18 of the heat spreading cup 14 when the heat transfer bracket 52 is in place. The sleeve 76 may be a closed sleeve that is compression fitted to the heat spreading cup 14 or may be an open sleeve with a clamping mechanism. An exemplary clamping mechanism for a sleeve 76 is described further below in association with another embodiment.

The petals 56 of the embodiment of FIGS. 14A, 14B, and 14C initially project outward from the forward end of the sleeve 76 and the central axis of the lighting fixture 10 and then curve back inward toward the central axis. Unlike the prior embodiments, the petals 56 extend rearward alongside and slightly beyond the rear surface of the bottom panel 20 (FIGS. 2, 3, and 4) of the heat spreading cup 14. When a lighting fixture 10 with a heat transfer bracket 52 of FIGS. 14A, 14B, and 14C is inserted in the recessed can assembly 60, the petals 56 may spring inward toward the central axis. A central portion of the outside surface of each of the petals 56 will make contact with the inside surface of the recessed can assembly 60. These points of contact will provide heat transfer points from the heat transfer bracket 52 to the recessed can assembly 60, and in select embodiments, may provide sufficient static friction to hold the lighting fixture 10 in position without supplemental attachment mechanisms.

In operation, most of the heat generated by the control module electronics 28 and the light source 34 is transferred to the bottom panel 20 of the heat spreading cup 14. Heat reaching the outer portion of the bottom panel of the heat spreading cup 14 is transferred along the side wall 18 of the heat spreading cup 14. The heat is transferred from the side wall 18 of the heat spreading cup 14 to the sleeve 76 and on to the petals 56. The heat is then transferred to the walls of the recessed can assembly 60 via the petals 56.

Figure 15A:
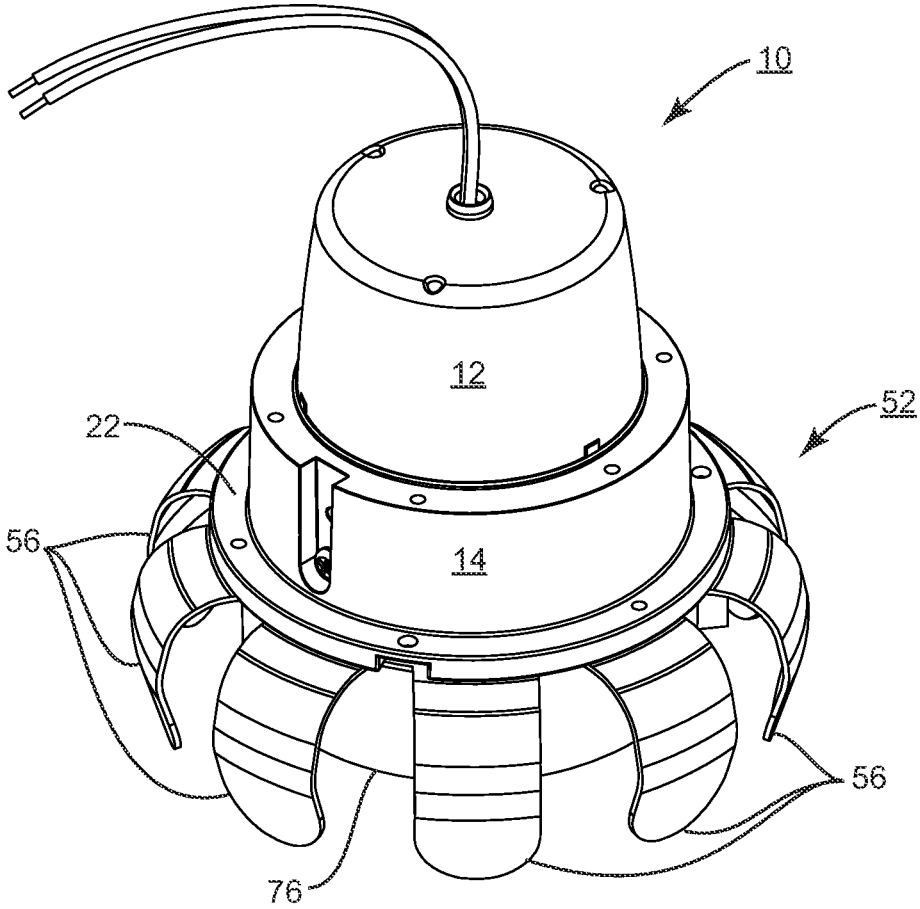
FIGS. 15A, 15B, and 15C are isometric, side plan, and top plan views of a lighting fixture with a heat transfer bracket according to one embodiment of the disclosure.
Figure 15B:
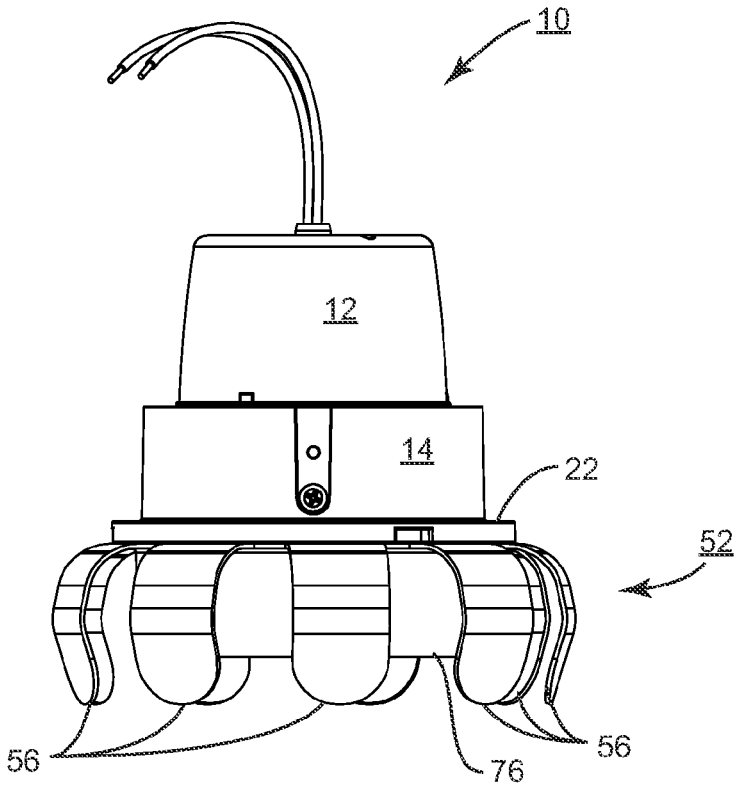
Figure 15C:
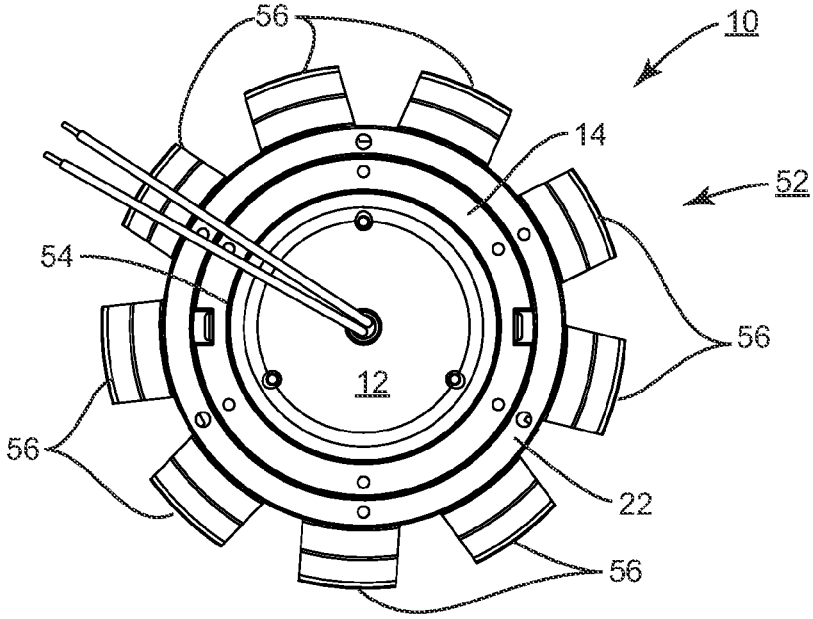

With reference to FIGS. 15A, 15B, and 15C, a heat transfer bracket 52 that is similar to that illustrated in FIGS. 14A, 14B, and 14C is attached to the front surface of the flange 22 of the heat spreading cup 14. The heat transfer bracket 52 is attached such that the petals 56 extend further forward along the central axis of the lighting fixture 10. Again, when a lighting fixture 10 with a heat transfer bracket 52 of FIGS. 15A, 15B, and 15C is inserted in the recessed can assembly 60, the petals 56 may spring inward toward the central axis. A central portion of the outside surface of each of the petals 56 will make contact with the inside surface of the recessed can assembly 60. These points of contact will provide heat transfer points from the heat transfer bracket 52 to the recessed can assembly 60, and in select embodiments, may provide sufficient static friction to hold the lighting fixture 10 in position without supplemental attachment mechanisms.

Figure 16A:
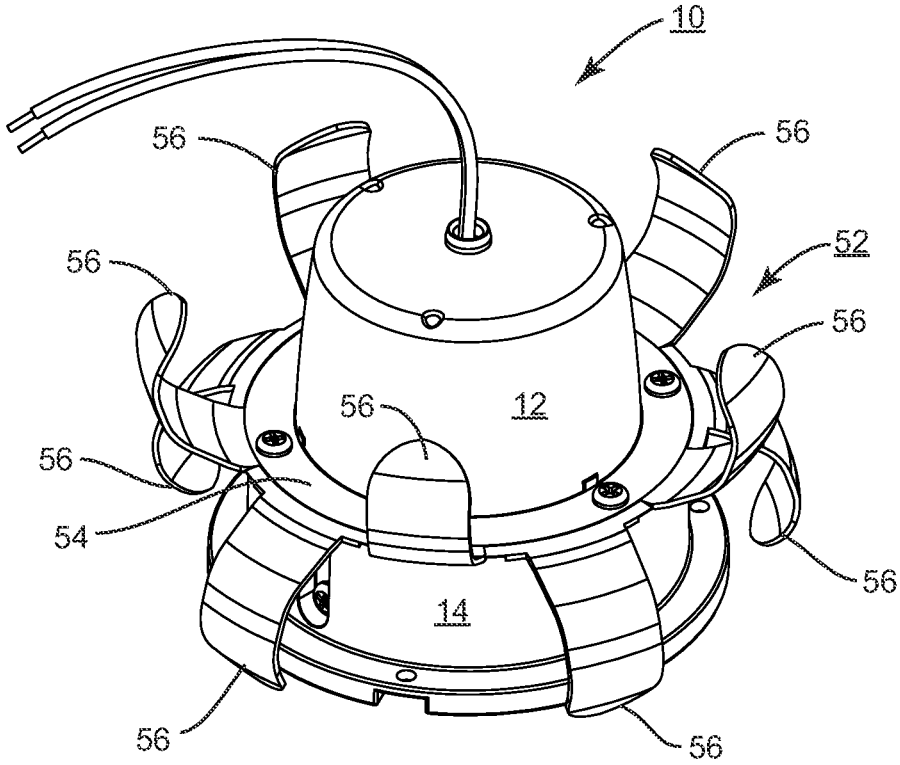
FIGS. 16A, 16B, and 16C are isometric, side plan, and top plan views of a lighting fixture with a heat transfer bracket according to one embodiment of the disclosure.
Figure 16B:
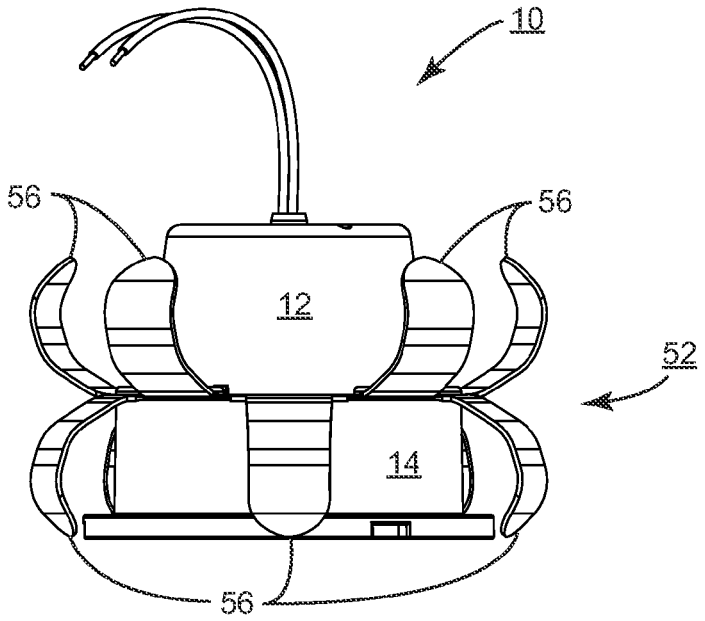
Figure 16C:
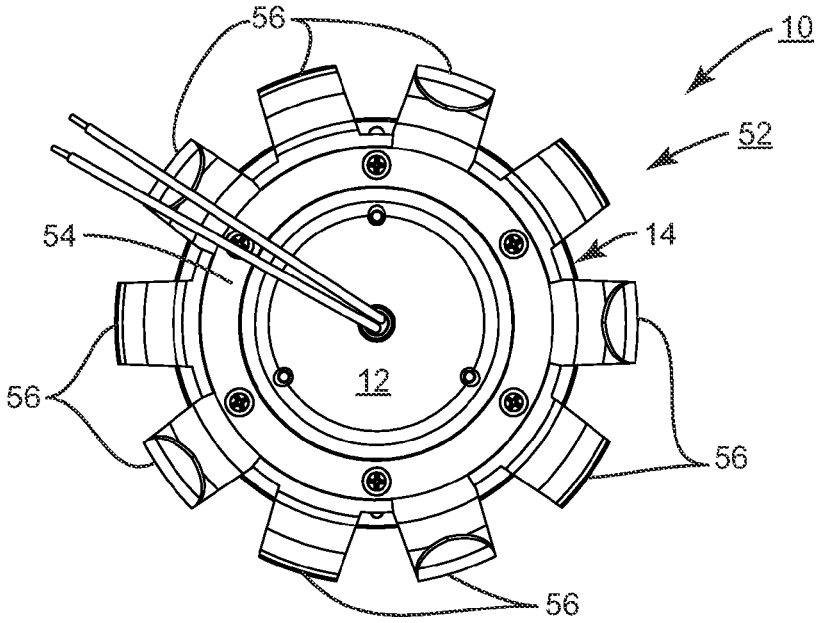

The heat transfer bracket 52 of FIGS. 16A, 16B, and 16C has curved petals 56 that extend from the base 54. In this embodiment, the base 54 of the heat transfer bracket 52 is once again mounted to the rear surface of the bottom panel 20 (FIGS. 2, 3, and 4) of the heat spreading cup 14. A first group of the petals 56 extends forward alongside and slightly beyond the side wall 18 of the heat spreading cup 14. A second group of petals 56 extends rearward along the side of the control module 12. Each of the petals 56 initially projects outward from the base 54 and the central axis of the lighting fixture 10 and then curves back inward toward the central axis. In this embodiment, the rearward and forward projecting petals 56 alternate with one another about the periphery of the base 54.

Figure 17A:
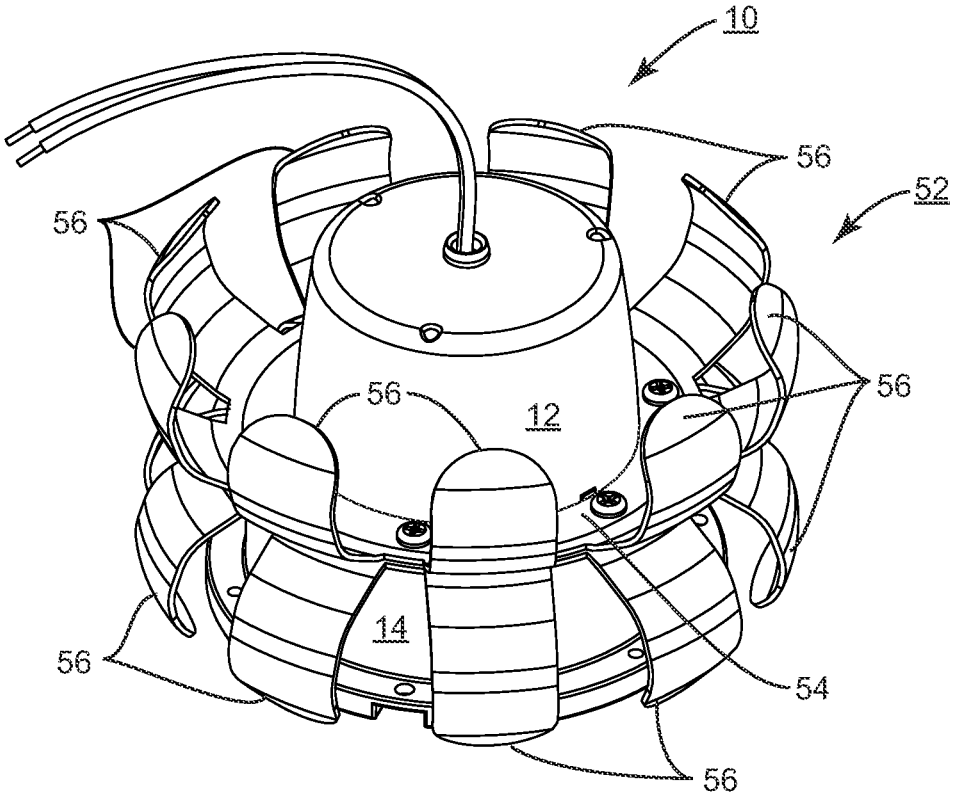
FIGS. 17A, 17B, and 17C are isometric, side plan, and top plan views of a lighting fixture with a heat transfer bracket according to one embodiment of the disclosure.
Figure 17B:
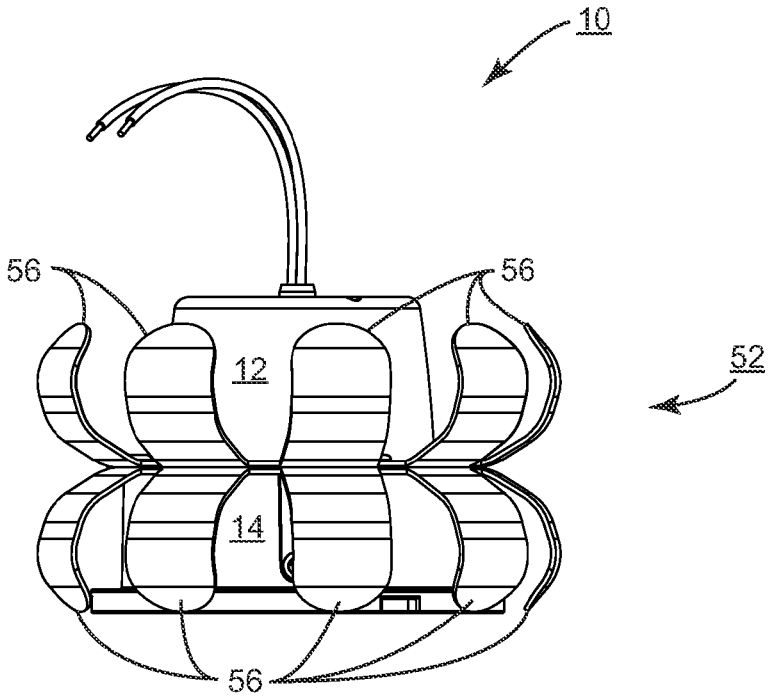
Figure 17C:
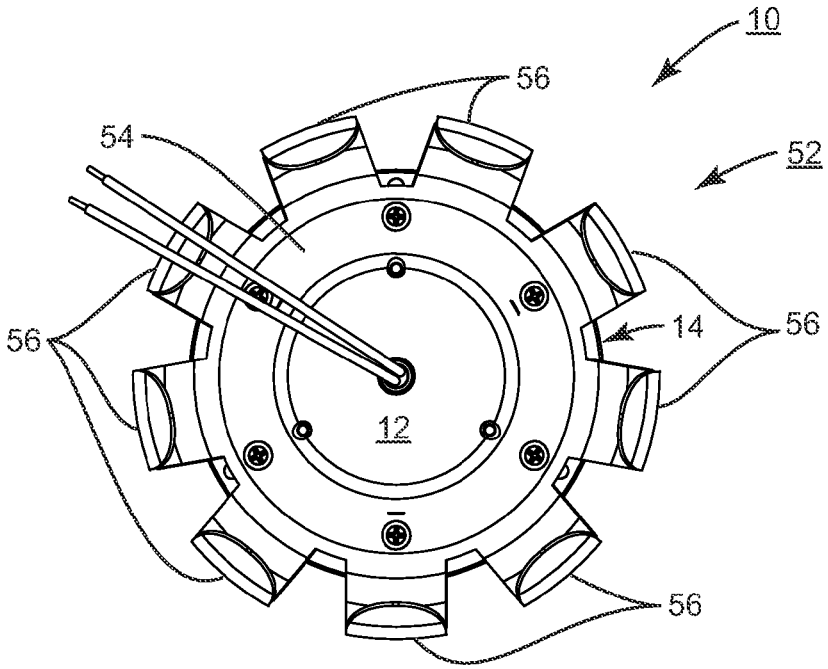

The heat transfer bracket 52 of FIGS. 17A, 17B, and 17C is similar to that of FIGS. 16A, 16B, and 16C, with the exception that for each rearward projecting petal 56, there is a forward projecting petal 56 substantially aligned therewith. As such, the embodiment of FIGS. 17A, 17B, and 17C has approximately twice the number of petals 56 as the embodiment of FIGS. 16A, 16B, and 16C. When a lighting fixture 10 with the heat transfer bracket 52 of FIGS. 17A, 17B, and 17C or FIGS. 16A, 16B, and 16C is inserted in the recessed can assembly 60, the petals 56 may spring inward toward the central axis. A central portion of the outside surface of each of the forward and rearward projecting petals 56 will make contact with the inside surface of the recessed can assembly 60. Again, these points of contact will provide heat transfer points from the heat transfer bracket 52 to the recessed can assembly 60, and in select embodiments, may provide sufficient static friction to hold the lighting fixture 10 in position without supplemental attachment mechanisms.

Figure 18A:
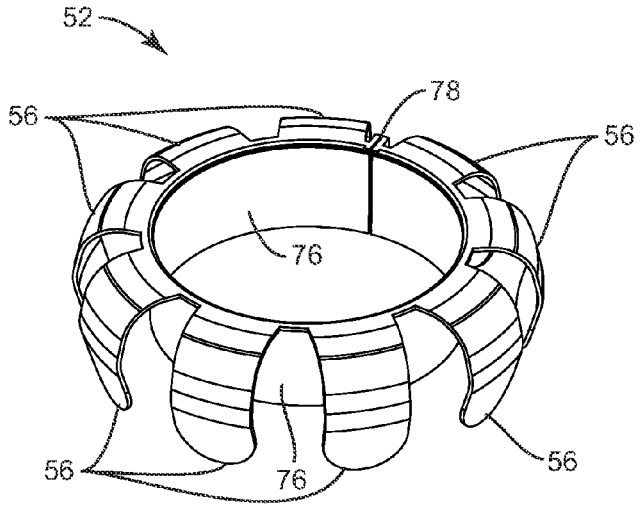
FIGS. 18A, 18B, and 18C are isometric, side plan, and top plan views of a heat transfer bracket according to one embodiment of the disclosure.
Figure 18B:
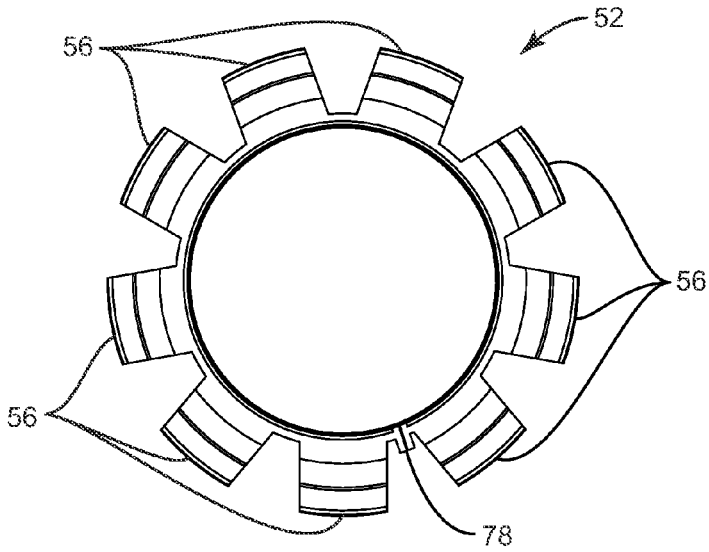
Figure 18C:
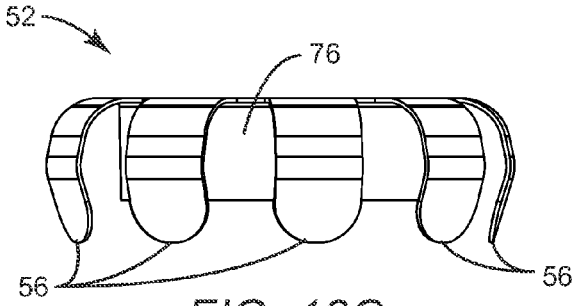

FIGS. 18A, 18B, and 18C provide perspective, plan, and side views of a heat transfer bracket 52 without the lighting fixture 10. The illustrated heat transfer bracket 52 has an open sleeve 76 and is otherwise similar to the one provided in FIGS. 14A, 14B, and 14C. Since the sleeve 76 is open, it does not have a continuous side wall, and as such, a clamping mechanism may be required to clamp the sleeve to the side wall 18 of the heat spreading cup 14. Use of an open sleeve 76 makes installing the heat transfer bracket 52 on the heat spreading cup 14 easy, because the open sleeve can expand to easily slide over or wrap around the heat spreading cup 14. Once in place, the clamping mechanism is used to clamp the respective ends of the sleeve 76 together, and in doing so, holds the heat transfer bracket 52 in place.

Figure 19A:
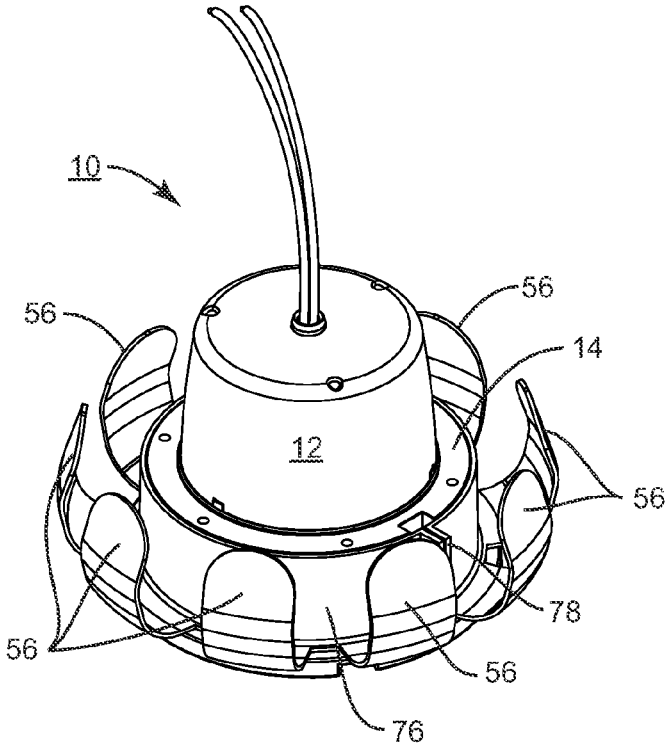
FIGS. 19A, 19B, 19C, 19D, and 19E are isometric, first side plan, second side plan, top plan, and exploded section views of a lighting fixture with a heat transfer bracket according to one embodiment of the disclosure.
Figure 19B:
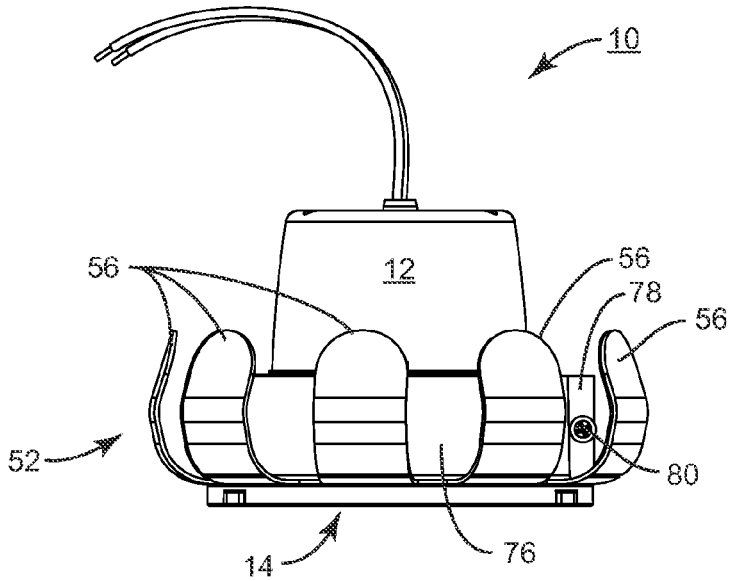
Figure 19C:
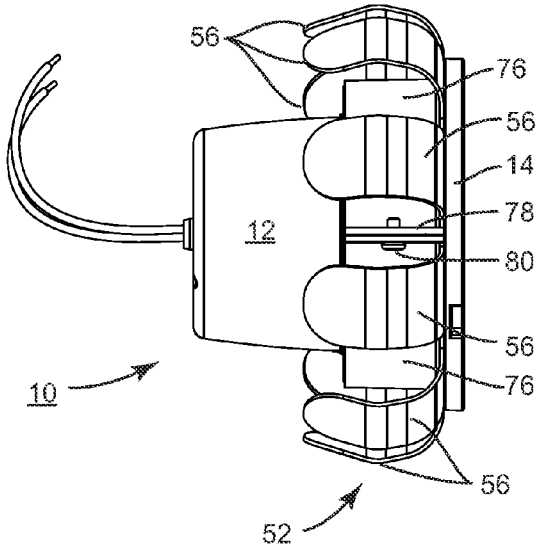
Figure 19D:
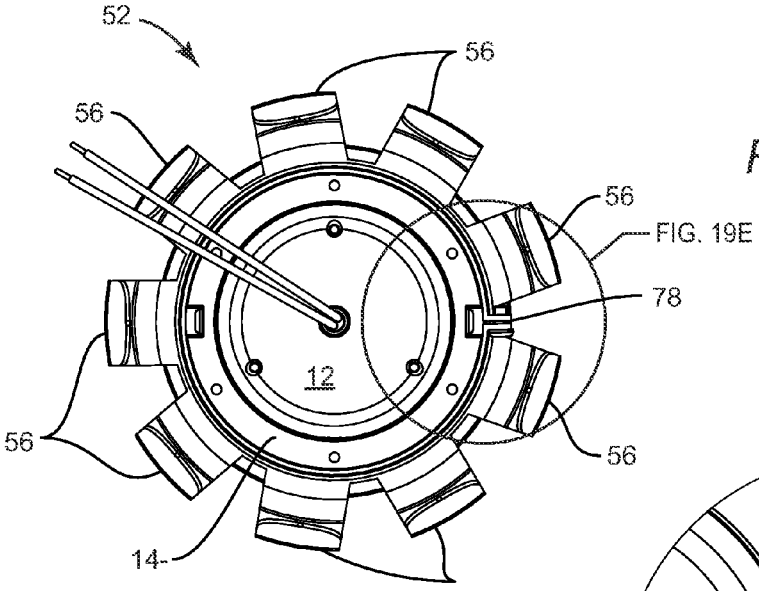
Figure 19E:
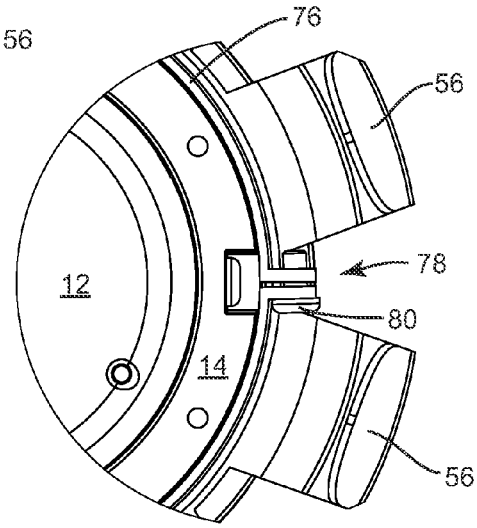

While numerous clamping mechanisms are available to one skilled in the art, the illustrated clamping mechanism is a clamp 78. The clamp 78 has two tabs on the respective ends of the sleeve 76. The tabs extend radially outward from the respective ends of the sleeve 76. One or more bolts or screws 80 may be used to couple the tabs together and effectively clamp the sleeve 76 about the side wall 18 of the heat spreading cup 14, as illustrated from different perspectives in FIGS. 19A-19E. FIG. 19E provides an enlarged view of the clamp 78 and the bolt or screw 80 that is used to connect the tabs, and thus the respective ends of the sleeve 76, together.

In any of the above embodiments, to increase the actual contact area between the heat spreading cup 14 and the heat transfer bracket 52 or the contact area between the heat transfer bracket 52 and the inside surface of the recessed can assembly 60, certain surfaces about intended contact areas may be textured. Texturing one or both surfaces of opposing intended contact areas can significantly increase the actual contact area between the surfaces. The amount of heat transfer between two structures generally increases as the amount of actual contact area between the two structures increases. As such, texturing one or both surface areas of the heat spreading cup 14 and the heat transfer bracket 52 that are supposed to contact one another may significantly increase heat transfer between the two structures. For example, the top or bottom surface of the base 54 or inside surface of the sleeve 76 may be textured, while a corresponding portion of the heat spreading cup 14 may also be textured. Similarly, texturing one or both surface areas of the heat transfer bracket 52 and the recessed can assembly 60 that are supposed to contact one another may significantly increase heat transfer between the two structures. For example, the outside surface of the petals 56 of the heat transfer bracket 52 may be textured, while corresponding portions of the inside surface of the recessed can assembly 60 may also be textured.

Figure 20A:
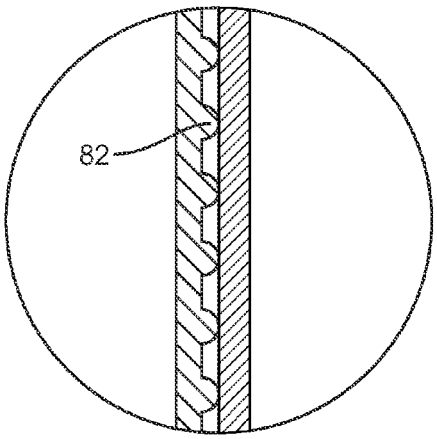
FIGS. 20A, 20B, 20C, and 20D illustrate exemplary surface texturing techniques according to one embodiment of the disclosure.
Figure 20B:
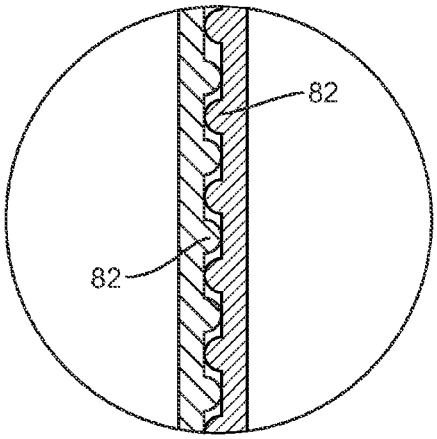
Figure 20C:
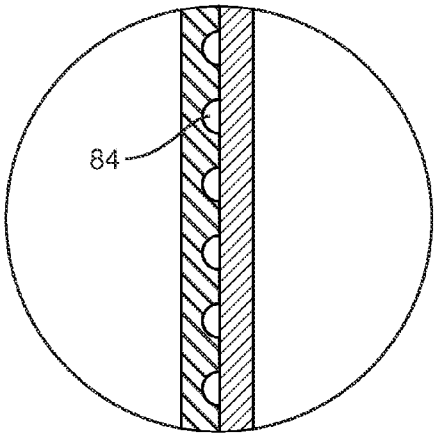
Figure 20D:
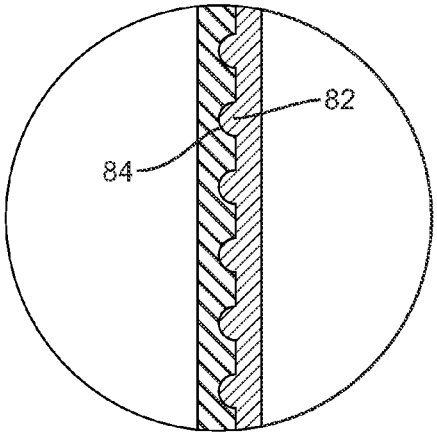

FIGS. 20A through 20D provide some exemplary texturing for contacting surfaces. FIG. 20A illustrates a cross section of two contacting surfaces where one surface is relatively smooth and the other includes bumps or ridges 82. FIG. 20B illustrates a cross section of two contacting surfaces where both surfaces include bumps or ridges 82. FIG. 20C illustrates a cross section of two contacting surfaces where one surface is relatively smooth and the other includes dimples or grooves 84. FIG. 20D illustrates a cross section of two contacting surfaces where one surface includes bumps or ridges 82 and the other includes dimples or grooves 84. While the bumps, ridges, dimples, and grooves 82, 84 are shown with a rounded contour, these features may have various contours, such as rectangular, triangular, saw toothed, and the like. Not only do these textured surfaces increase the actual contacting surfaces between two surfaces, these textures increase the coefficient of static friction between the two surfaces. As such, providing appropriate texturing on the petals 56 of the heat transfer bracket 52, the inside surface of the recessed can assembly 60, or both increases the ability of the petals 56 to hold the lighting fixture 10 within the recessed can assembly 60 without additional attachment mechanisms. Tabs, burrs, spikes, or like components may also be added to the surfaces to further increase the coefficient of static friction therebetween. Applying such components on the outside surface of the petals 56 is particularly effective.

Figure 21A:
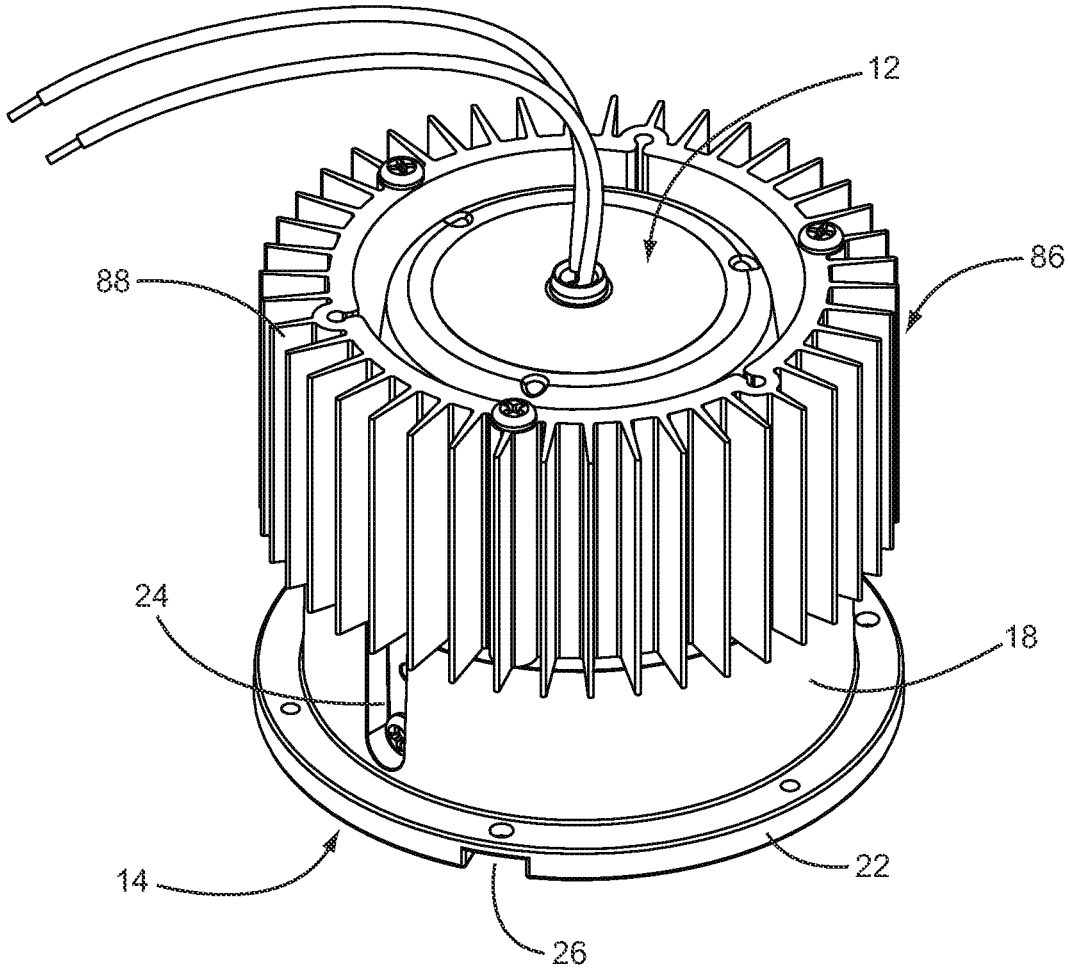
FIGS. 21A and 21B are isometric views of the rear and front of the heat spreading cup of the lighting fixture of FIG. 1 with an optional heat sink.
Figure 21B:
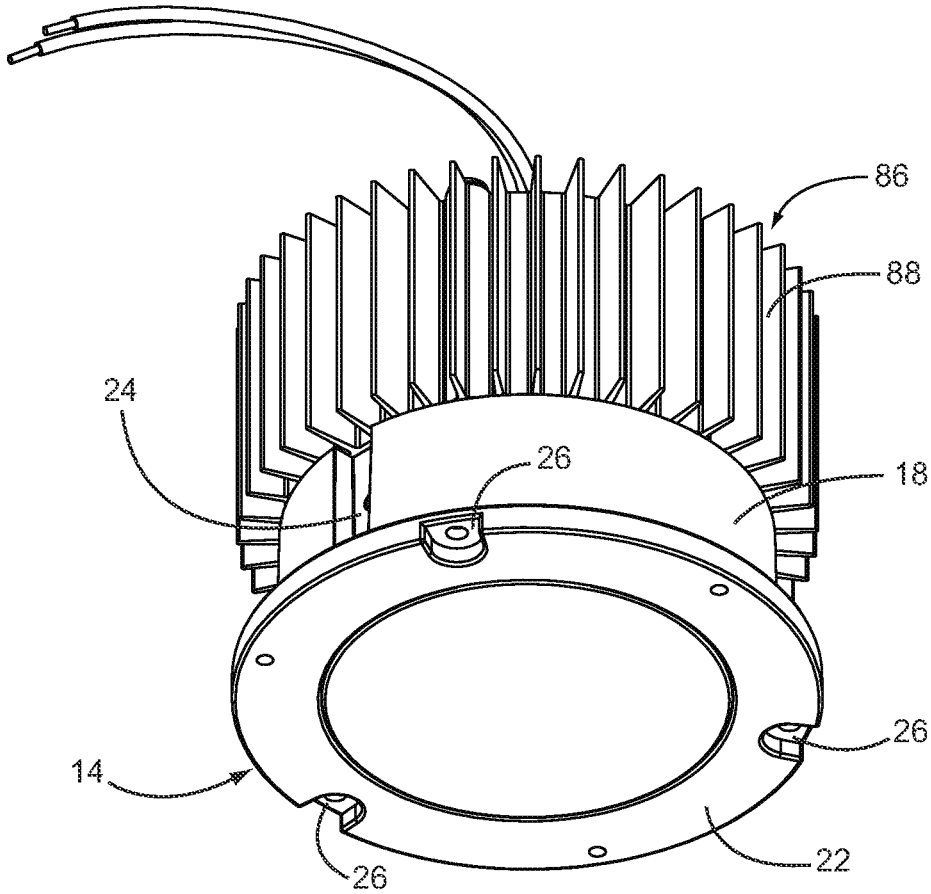

With reference to FIGS. 21A and 21B, an optional heat sink 86 may be provided for the lighting fixture 10. In the illustrated embodiment, the heat sink 86 is substantially cylindrical and provides an interior opening that is sized to receive the control module 12 and rest against an outer portion of the rear surface of the bottom panel 20 of the heat spreading cup 14. The heat sink 86 includes radial fins 88 that are substantially parallel to the central axis of the lighting fixture 10. A thermally conductive pad or other material may be provided between the heat sink 86 and the heat spreading cup 14 to enhance the thermal coupling of the heat sink 86 and the heat spreading cup 14. Similar pads or materials may be provided between any contact surfaces on the recessed can assembly 60, heat transfer bracket 52, and heat spreading cup 14 through which heat is transferred.

Without the heat sink 86, most of the heat generated by the control module electronics 28 and the light source 34 is transferred outward to the heat spreading cup 14 and then to the recessed can assembly 60 via the heat transfer bracket 52 as well as along the side wall 18 toward the front of the lighting fixture 10. As such, a significant amount, if not a majority, of the heat is transferred to the front of the lighting fixture 10, instead of being transferred to the rear of the lighting fixture where it may be trapped within the cavity in which the lighting fixture is mounted. In embodiments where the heat sink 86 is provided, a certain amount of the heat that is transferred outward along the bottom panel 20 of the heat spreading cup 14 will be transferred rearward to the heat sink 86.

Those skilled in the art will recognize improvements and modifications to the embodiments of the present disclosure. All such improvements and modifications are considered within the scope of the concepts disclosed herein and the claims that follow.

What is claimed is:

1. A lighting apparatus comprising:

a heat spreading structure;

a light source and associated control electronics that are thermally coupled to the heat spreading structure and configured to emit light such that heat generated by the light source and the associated control electronics during operation is transferred to the heat spreading structure; and a heat transfer bracket comprising a base that is thermally coupled to the heat spreading structure and a plurality of petals that extend from the base, such that the heat transferred to the heat spreading structure is further transferred along the plurality of petals, wherein the heat spreading structure, the light source, and the heat transfer bracket form at least a portion of a lighting fixture configured to mount within a recessed can assembly providing an opening that leads to an interior cavity that has an interior surface, wherein the plurality of petals are configured to spring radially inward and press against the interior surface of the recessed can assembly when the lighting fixture is placed in the interior cavity, such that the heat transferred along the plurality of petals is further transferred to the recessed can assembly.

2. The lighting apparatus of claim 1 wherein at least portions of surfaces of the plurality of petals intended to make contact with the interior surface of the recessed can assembly are textured.

3. The lighting apparatus of claim 2 wherein the surfaces that are textured comprise at least one of a group consisting of bumps, ridges, grooves, and dimples.

4. The lighting apparatus of claim 1 wherein the plurality of petals extend substantially from and are distributed substantially about a periphery of the base.

5. The lighting apparatus of claim 4 wherein the plurality of petals are biased radially outward from a central axis and extend substantially in a forward direction wherein the forward direction is substantially aligned with a direction of a primary light beam generated by the lighting apparatus.

6. The lighting apparatus of claim 4 wherein the plurality of petals are biased radially outward from a central axis and extend substantially in a direction that is opposite a direction that is substantially aligned with a direction of a primary light beam generated by the lighting apparatus.

7. The lighting apparatus of claim 4 wherein a first group of the plurality of petals are biased radially outward from a central axis and extend substantially in a forward direction, which is substantially aligned with a direction of a primary light beam generated by the lighting apparatus, and a second group of the plurality of petals are biased radially outward from the central axis and extend substantially in a rearward direction that is opposite the forward direction.

8. The lighting apparatus of claim 7 wherein each petal in the first group of the plurality of petals is substantially aligned with each petal in the second group of the plurality of petals.

9. The lighting apparatus of claim 7 wherein petals in the first group of the plurality of petals are separated by spaces and petals in the second group of the plurality of petals are separated by spaces such that the petals in the first group of the plurality of petals and the petals in the second group of the plurality of petals alternate with one another.

10. The lighting apparatus of claim 1 wherein the base is a ring.

11. The lighting apparatus of claim 1 wherein the base is a sleeve.

12. The lighting apparatus of claim 11 wherein the sleeve is open and comprises a first end, a second end, and a clamp mechanism configured to clamp the first end to the second end.

13. The lighting apparatus of claim 1 wherein the plurality of petals are predominately curved.

14. The lighting apparatus of claim 1 wherein the plurality of petals are predominately linear.

15. The lighting apparatus of claim 1 wherein each of at least certain of the plurality of petals spring radially outward from a central axis, extend substantially in a forward direction, and comprise a tab that extends substantially radially outward from a distal end, wherein the forward direction is substantially aligned with a direction of a primary light beam generated by the lighting apparatus.

16. The lighting apparatus of claim 1 wherein the heat transfer bracket is mounted to the heat spreading structure.

17. The lighting apparatus of claim 1 wherein:

the heat spreading structure is a heat spreading cup comprising a bottom panel, a rim, and at least one side wall extending between the bottom panel and the rim;

the light source is coupled inside the heat spreading cup to the bottom panel and configured to emit light in a forward direction through an opening formed by the rim; and the light source and the associated control electronics are thermally coupled to the bottom panel such that the heat generated by the light source during operation is transferred radially outward along the bottom panel and in the forward direction along the at least one side wall toward the rim.

18. The lighting apparatus of claim 17 wherein the heat transfer bracket is mounted to the heat spreading cup.

19. The lighting apparatus of claim 18 wherein the associated control electronics are coupled to a rear side of the bottom panel opposite the light source and the base of the heat transfer bracket is coupled to the bottom panel and extends around the associated control electronics.

20. The lighting apparatus of claim 18 wherein the heat transfer bracket is mounted about an outside surface of the at least one side wall of the heat spreading cup.

21. The lighting apparatus of claim 18 wherein the heat transfer bracket is mounted to the rim of the heat spreading cup.

22. A heat transfer bracket for a lighting fixture, which comprises a heat spreading structure as well as a light source and associated control electronics that are thermally coupled to the heat spreading structure and configured to emit light in a forward direction such that heat generated by the light source and the associated control electronics during operation is transferred to the heat spreading structure, wherein the forward direction is substantially aligned with a direction of a primary light beam generated by the lighting apparatus, the heat transfer bracket comprising:

a base that is configured to be thermally coupled to the heat spreading structure; and a plurality of petals that extend from the base such that the heat transferred to the heat spreading structure is further transferred to the base and then along the plurality of petals, wherein when the heat transfer bracket is attached to the lighting fixture and thermally coupled to the light source and the associated control electronics, the lighting fixture is configured to mount within a recessed can assembly providing an opening that leads to an interior cavity that has an interior surface wherein the plurality of petals are configured to spring radially inward and press against the interior surface of the recessed can assembly when the lighting fixture is placed in the interior cavity, such that the heat transferred along the plurality of petals is further transferred to the recessed can assembly.

23. The heat transfer bracket of claim 22 wherein at least portions of surfaces of the plurality of petals intended to make contact with the interior surface of the recessed can assembly are textured.

24. The heat transfer bracket of claim 23 wherein the surfaces that are textured comprise at least one of a group consisting of bumps, ridges, grooves, and dimples.

25. The heat transfer bracket of claim 22 wherein the plurality of petals extend substantially from and are distributed substantially about a periphery of the base.

26. The heat transfer bracket of claim 25 wherein the plurality of petals are biased radially outward from a central axis and extend substantially in a forward direction, wherein the forward direction is substantially aligned with a direction of a primary light beam generated by the lighting apparatus.

27. The heat transfer bracket of claim 25 wherein the plurality of petals are biased radially outward from a central axis and extend substantially in a direction that is opposite a direction substantially aligned with a direction of a primary light beam generated by the lighting apparatus.

28. The heat transfer bracket of claim 25 wherein a first group of the plurality of petals are biased radially outward from a central axis and extend substantially in a forward direction, wherein the forward direction is substantially aligned with a direction of a primary light beam generated by the lighting apparatus, and a second group of the plurality of petals are biased radially outward from the central axis and extend substantially in a rearward direction that is opposite the forward direction.

29. The heat transfer bracket of claim 28 wherein each petal in the first group of the plurality of petals is substantially aligned with each petal in the second group of the plurality of petals.

30. The heat transfer bracket of claim 28 wherein petals in the first group of the plurality of petals are separated by spaces and petals in the second group of the plurality of petals are separated by spaces such that the petals in the first group of the plurality of petals and the petals in the second group of the plurality of petals alternate with one another.

31. The heat transfer bracket of claim 22 wherein the base is a ring.

32. The heat transfer bracket of claim 22 wherein the base is a sleeve.

33. The heat transfer bracket of claim 32 wherein the sleeve is open and comprises a first end, a second end, and a clamp mechanism configured to clamp the first end to the second end.

34. The heat transfer bracket of claim 22 wherein the plurality of petals are predominately curved.

35. The heat transfer bracket of claim 22 wherein the plurality of petals are predominately linear.

36. The heat transfer bracket of claim 22 wherein each of at least certain of the plurality of petals spring radially outward from a central axis, extend substantially in a forward direction, and comprise a tab that extends substantially radially outward from a distal end, wherein the forward direction is substantially aligned with a direction of a primary light beam generated by the lighting apparatus.

* * * * *